US010007203B2

(12) United States Patent
Miyao et al.

(10) Patent No.: US 10,007,203 B2
(45) Date of Patent: Jun. 26, 2018

(54) COMPLEX PARTICLE, EXTERNAL ADDITIVE FOR TONER AND METHOD OF PREPARING COMPLEX PARTICLE

(71) Applicant: SAMSUNG ELECTRONICS CO., LTD., Suwon-si, Gyeonggi-do (KR)

(72) Inventors: Hiroshi Miyao, Yokohama (JP); Hiromichi Jin, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 179 days.

(21) Appl. No.: 15/009,964

(22) Filed: Jan. 29, 2016

(65) Prior Publication Data

US 2016/0223928 A1 Aug. 4, 2016

(30) Foreign Application Priority Data

Jan. 30, 2015 (JP) ..... 2015-016679
Aug. 31, 2015 (KR) ..... 10-2015-0123238

(51) Int. Cl.
*G03G 9/093* (2006.01)

(52) U.S. Cl.
CPC ..... *G03G 9/09342* (2013.01); *G03G 9/09392* (2013.01)

(58) Field of Classification Search
CPC ..... G03G 9/09342; G03G 9/09392
See application file for complete search history.

(56) References Cited

U.S. PATENT DOCUMENTS 5,705,306 A 1/1998 Kitani et al.
2006/0292344 A1 12/2006 Winkler et al.
(Continued)

FOREIGN PATENT DOCUMENTS

JP 61114248 * 5/1986
JP 08314182 A 11/1996
(Continued)

*Primary Examiner* — Irina S Zemel
(74) *Attorney, Agent, or Firm* — NSIP Law

(57) ABSTRACT

A complex particle including a core particle and a shell particle, wherein the shell particle is disposed on the core particle, wherein the core particle includes an organic material or an inorganic material as a primary component and the shell particle includes the other of the organic material and the inorganic material as a primary component, wherein an average particle diameter of the core particle is greater than or equal to about 80 nanometers and less than or equal to about 300 nanometers, a coefficient of variation of an average particle diameter of the core particle is greater than or equal to about 2% and less than or equal to about 10%, an average particle diameter of the shell particle is greater than or equal to about 5 nanometers and less than or equal to about 30 nm, a ratio of the average particle diameter of the shell particle relative to the average particle diameter of the core particle is greater than or equal to about 0.016 and less than or equal to about 0.25, an average particle diameter of the complex particle is greater than or equal to about 90 nanometers and less than or equal to about 350 nanometers, a ratio of multipliers a volume resistance and a sheet resistance of the complex particle is greater than or equal to about 0.7 and less than or equal to about 1.4, wherein the ratio of multipliers is a ratio of $\beta_1/\beta_2$, wherein $\beta_1$ is an exponent in an expression of the volume resistance according to the formula $\rho_v=\alpha_1\cdot 10^{\beta 1}$ and wherein $\beta_2$ is an exponent in an expression of the sheet resistance according to the formula $\rho_s=\alpha_2\cdot 10^{\beta 2}$ and (Continued)

wherein a change of a number of shell particles present on the core particle before and after ultrasonic irradiation of a dispersion liquid of the complex particle including about 1 weight percent of the complex particle dispersed in water is greater than or equal to about 0.5% and less than or equal to about 5%$\rho_v\rho_s$.

12 Claims, 6 Drawing Sheets

(56) References Cited

U.S. PATENT DOCUMENTS

| | | | | |
|---|---|---|---|---|
| 2007/0009823 | A1 | 1/2007 | Skorokhod et al. | |
| 2009/0246674 | A1* | 10/2009 | Carlini | B82Y 30/00 430/110.2 |
| 2011/0159427 | A1* | 6/2011 | Kang | G03G 9/0819 430/108.6 |
| 2011/0195099 | A1 | 8/2011 | Nolte et al. | |
| 2012/0156602 | A1* | 6/2012 | Yamazaki | G03G 9/08755 430/105 |
| 2013/0101934 | A1 | 4/2013 | Chiba et al. | |

FOREIGN PATENT DOCUMENTS

| | | | | |
|---|---|---|---|---|
| JP | 2002131976 | A | 5/2002 | |
| JP | 2002182424 | A | 6/2002 | |
| JP | 2002287407 | A | 10/2002 | |
| JP | 2005048176 | A | 2/2005 | |
| JP | 2005099400 | A | 4/2005 | |
| JP | 2005173480 | A | 6/2005 | |
| JP | 2005202131 | A | 7/2005 | |
| JP | 2005202133 | A | 7/2005 | |
| JP | 2007504307 | A | 3/2007 | |
| JP | 2011518900 | A | 6/2011 | |
| JP | 2011149984 | A | 8/2011 | |
| JP | 2012013776 | A | 1/2012 | |
| JP | 2012073468 | A | 4/2012 | |
| JP | 2012189881 | A | 10/2012 | |
| JP | 2014065014 | A | 4/2014 | |
| JP | 2014144891 | A | 8/2014 | |
| KR | 1020080093740 | A | 10/2008 | |
| WO | WO-2012002278 | A1 * | 1/2012 | G03G 9/0819 |

* cited by examiner

COMPLEX PARTICLE, EXTERNAL ADDITIVE FOR TONER AND METHOD OF PREPARING COMPLEX PARTICLE

CROSS-REFERENCE TO RELATED APPLICATION

This application claims priority to and the benefit of Japanese Patent Application No. 2015-016679, filed in the Japanese Patent Office on Jan. 30, 2015, and Korean Patent Application No. 10-2015-0123238, filed in the Korean Intellectual Property Office on Aug. 31, 2015, and all the benefits accruing therefrom under 35 U.S.C. § 119, the contents of which are incorporated herein by reference in their entirety.

BACKGROUND

1. Field

This disclosure relates to a complex particle as a component of a toner external additive that is externally added to a toner for an electrophotography, a method of preparing the same, and an external additive for a toner including the complex particle.

2. Description of the Related Art

Complex particles include organic materials and inorganic materials to provide various characteristics.

Complex particles may include a core-shell type particle having a structure where a shell including an inorganic material is coated on the surface of a core including a resin particle, or a secondary particle which is an agglomeration of smaller primary particles in which an inorganic material is attached to the surface of a core particle having a large particle diameter formed of an organic material. Complex particles having various shapes and structures have been developed.

Complex particles are applicable to electrophotography toner. Nonetheless, there remains a need for an improved complex particle for electrophotography toner.

SUMMARY

Disclosed is a complex particle including: a core particle and a shell particle, wherein the shell particle is disposed on the core particle, wherein the core particle includes an organic material or an inorganic material as a primary component and the shell particle includes the other of the organic material and the inorganic material as a primary component, wherein an average particle diameter of the core particle is greater than or equal to about 80 nanometers and less than or equal to about 300 nanometers, a coefficient of variation of an average particle diameter of the core particle is greater than or equal to about 2% and less than or equal to about 10%, an average particle diameter of the shell particle is greater than or equal to about 5 nanometers and less than or equal to about 30 nanometers, a ratio of the average particle diameter of the shell particle relative to the average particle diameter of the core particle is greater than or equal to about 0.016 and less than or equal to about 0.25, an average particle diameter of the complex particle is greater than or equal to about 90 nanometers and less than or equal to about 350 nanometers, a ratio of multipliers a volume resistance and a sheet resistance of the complex particle is greater than or equal to about 0.7 and less than or equal to about 1.4, wherein the ratio of multipliers is a ratio of $\beta_1/\beta_2$, wherein $\beta_1$ is an exponent in an expression of the volume resistance according to the formula $\rho_v=\alpha_1\cdot 10^{\beta 1}$ and wherein $\beta_2$ is an exponent in an expression of the sheet resistance according to the formula $\rho_s=\alpha_2\cdot 10^{\beta 2}$, and wherein a change of a number of shell particles present on the core particle before and after ultrasonic irradiation of a dispersion liquid of the complex particle including about 1 weight percent of the complex particle dispersed in water, using a power of about 110 Watts and a frequency of about 31 kiloHertz for about 30 minutes, is greater than or equal to about 0.5% and less than or equal to about 5%.

Also disclosed is method of preparing a complex particle including a core particle and a shell particle, the method including: providing a mixture including an organic particle and separately providing a mixture including an inorganic particle; combining the mixture comprising the organic particle and the mixture including the inorganic core particle to form a dispersion liquid; adding an acid to the dispersion liquid until the dispersion liquid reaches an isoelectric point of an inorganic material of the inorganic core particle; and then heating the dispersion liquid to form a particle adhesion body comprising the inorganic particle on the organic particle; and adding a silane coupling agent to the heated dispersion liquid to prepare the complex particle.

An external additive for a toner includes the complex particle.

BRIEF DESCRIPTION OF THE DRAWINGS

The above and other advantages and features of this disclosure will become more apparent by describing in further detail exemplary embodiments thereof with reference to the accompanying drawings, in which.

DETAILED DESCRIPTION

Figure 1:
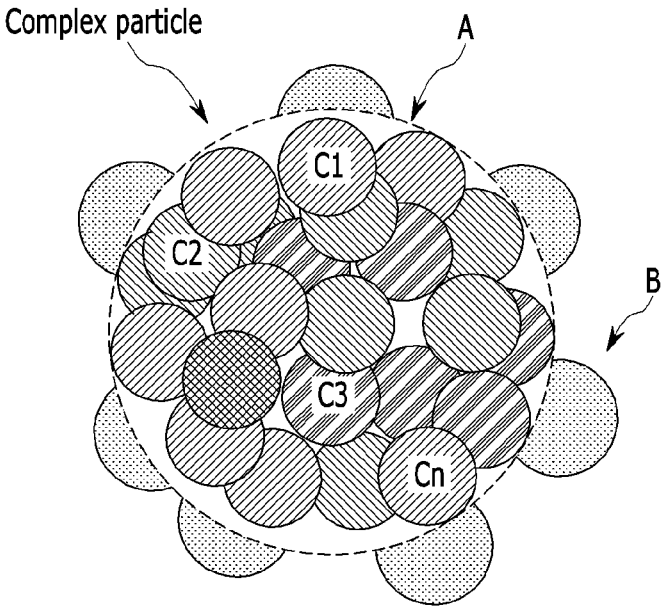
FIG. 1 is a schematic view showing an embodiment of a complex particle based on an image of a scanning electron microscope (SEM)

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments will hereinafter be described further detail. However, this disclosure may be embodied in many different forms, and is not to be construed as limited to the exemplary embodiments set forth herein.

Organic core-shell type complex particles have high flexibility and have a spherical shape, and thus, a shape of a core part may be easily deformed, and a spherical shape is not maintained when the particle is stressed.

When the complex particles are not capable of maintaining a spherical shape, flowability of complex particles may be deteriorated, and thus it is difficult that a toner for an electrophotography is provided with an appropriate flowability.

Secondary, e.g., raspberry-shaped complex particles, can have a structure wherein shell particles (particulates) are attached on core particles, and an adhesion strength of the shell particles on the core particles is low.

When the adhesion strength of shell particles on the core particles is low and the particles are stressed, the shell particles may be easily detached from core particles and thus, initial characteristics are difficult to maintain.

Raspberry-shaped complex particle shave a structure where shell particles formed of an inorganic material and shell particles formed of an organic material are bonded by an organic hydrophobizing agent, and have higher adhesion strength between particles compared with other raspberry shaped complex particles.

However, in such raspberry shaped complex particles, organic components derived from the organic hydrophobizing agent on the surfaces may be exposed.

The organic components have a higher charge amount than inorganic components. Therefore, when a large amount of organic components are present on the surface of the complex particles, it is difficult to control a charge amount of the complex particles.

For example, the raspberry shaped complex particle including nano sized inorganic particles attached to the surface of core particles formed of organic polymers may be used as a water-repellency material because water repellency is provided by fine protrusions and depressions in the surface structure of the inorganic particles through a lotus-leaf effect.

The raspberry-shaped complex particle has been used as a carrier for a catalyst due to its large specific area compared with spherical shaped particles without protrusions and depressions on their surface.

The raspberry-shaped complex particle may draw attention in terms of extensions of new applications by characteristics from the structure or surface shapes.

Therefore, there remains a need for improved raspberry-shaped complex particles to extend the range of applications in which such materials can be used.

This disclosure relates to a complex particle which provides improved flowability, a method of preparing the same, and an external additive for a toner including the complex particle.

This disclosure relates to the following structures.

Structure 1

A complex particle includes a core particle and a shell particle on the core particle, wherein the core particle comprises an organic material or an inorganic material as a primary component and the shell particle comprises the other of the organic material and the inorganic material as a primary component, wherein an average particle diameter of the core particle is greater than or equal to about 80 nm and less than or equal to about 300 nm, and a coefficient of variation of an average particle diameter of the core particle is greater than or equal to about 2% and less than or equal to about 10%, wherein an average particle diameter of the shell particle is greater than or equal to about 5 nm and less than or equal to about 30 nm, and a ratio of the average particle diameter of the shell particle relative to the average particle diameter of the core particle is greater than or equal to about 0.016 and less than or equal to about 0.25, an average particle diameter of the complex particle is greater than or equal to about 90 nm and less than or equal to about 350 nm, a ratio $\beta_1/\beta_2$ of multipliers in a volume resistance according to the formula $\rho_v=\alpha_1\cdot 10^{\beta 1}$ ($\Omega\cdot$cm) and a sheet resistance according to the formula $\rho_s=\alpha_2\cdot 10^{\beta 2}$ ($\Omega/cm^2$) of the complex particle is greater than or equal to about 0.7 and less than or equal to about 1.4, and a change of the number of the shell particles present on the core particle before and after ultrasonic irradiation of a complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%.

Structure 2

An embodiment in which a relative permittivity of the complex particle is greater than or equal to about 2 and less than or equal to about 300 in the Structure 1.

Structure 3

An embodiment in which a coating ratio of the shell particle on the surface of the core particle is greater than or equal to about 5% and less than about 68% in the Structure 1 or 2. In an embodiment, a percentage of the core particle which is coated with the shell particle is greater than or equal to about 5% and less than about 68%, based on a total surface area of the core particle Structure 4

In an embodiment, the core particle comprises an organic material and the shell particle comprises an inorganic material.

Structure 5

The complex particle may include a shell particle comprising an organic material.

Structure 6

The inorganic material may comprise silica, titania, cerium oxide, strontium titanate, or combination thereof.

Structure 7

The core particle may comprise an inorganic material and the shell particle may comprise an organic material.

Structure 8

The complex particle may comprise a shell particle comprising an inorganic material.

Structure 9

The inorganic material may comprise silica, titania, cerium oxide, strontium titanate, or combination thereof.

Structure 10

The complex particle may comprise an inorganic material layer coating the surface of the core particle and the shell particle.

Structure 11

An external additive for a toner includes the complex particle.

Structure 12

A method of preparing a complex particle including a core particle and a and a shell particle includes providing a mixture comprising an organic particle and separately providing a mixture comprising an inorganic particle; combining the mixture comprising the organic particle and the mixture comprising the inorganic core particle to form a dispersion liquid; adding an acid to the dispersion liquid until the dispersion liquid reaches an isoelectric point of an inorganic material of the inorganic core particle; and then heating the dispersion liquid to form a particle adhesion body comprising the inorganic particle on the organic particle; and adding a silane coupling agent to the heated dispersion liquid to prepare the complex particle.

The process may include forming a particle adhesion body wherein the shell particle is adhered on the surface of the core particle to provide a particle adhesion body, using dispersion liquid including the core particle including an organic material and an inorganic material as a primary component and the shell particle including the other of the organic material and the inorganic material different from the core particle as a main component, and a process of forming a complex particle wherein a silane coupling agent and a basic material that are bound to one of the core particle and the shell particle and simultaneously interact the other, are added to the dispersion liquid including the particle adhesion body, and the shell particle is fixed on the surface of the core particle to provide the complex particle. The complex particle includes the core particle and the shell particles, the main component of the core particle is one of an organic material and an inorganic material, the shell particle is present on the core particle, the main component of the shell particle is one of the organic material and the inorganic material, that is, when the main component of the core particle is an organic material, the main component of the shell particle is an inorganic material, while when the main component of the core particle is an inorganic material, the main component of the shell particle is an organic material, an average particle diameter of the core particle is greater than or equal to about 80 nm and less than or equal to about 300 nm, and a coefficient of variation of an average particle diameter of the core particle is greater than or equal to about 2% and less than or equal to about 10%, an average particle diameter of the shell particle is greater than or equal to about 5 nm and less than or equal to about 30 nm, and a ratio of the average particle diameter of the shell particle relative to the average particle diameter of the core particle is greater than or equal to about 0.016 and less than or equal to about 0.25, an average particle diameter of the complex particle is greater than or equal to about 90 nm and less than or equal to about 350 nm, a ratio $\beta_1/\beta_2$ of multipliers in a volume resistance $\rho_v=\alpha_1\cdot 10^{\beta 1}$ ($\Omega\cdot$m) and a sheet resistance $\rho_s=\alpha_2\cdot 10^{\beta 2}$ ($\Omega/cm^2$) of the complex particle is greater than or equal to about 0.7 and less than or equal to about 1.4, and a change of the shell particle present on the core particle before and after irradiating an ultrasonic wave to complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%.

The complex particle having the properties provides the following effects.

(i) The complex particle includes the shell particle present on the surface of the core particle, has a too low change of the shell particle on the core particle before and after irradiation of an ultrasonic wave under an predetermined condition, and thus has a high adhesion strength of the shell particle on the core particle compared with a conventional complex particle including a shell particle that simply attached to the core particle. Because the adhesion strength of the shell particle on the core particle, the shell particle is not detached from the core particle even if the complex particle gets various stresses such as a shear force.

(ii) The complex particle has a relative permittivity within a predetermined range due to the volume resistance $\rho_v$ and the sheet resistance $\rho_s$ within the predetermined numeral ranges, charges as initial characteristics rapidly increase, and a charge level is maintained, that is a satisfactory charge amount may be ensured. The satisfactory charge amount may be maintained for a long time because the adhesion strength of the shell particle on the core particle is high and the shell particle is difficult to be detached from the core particle.

(iii) Because the core particle and the shell particle have a ratio of an average particle diameter and an average particle diameter within predetermined numeral ranges, and simultaneously a coating ratio within predetermined numeral ranges, when it is used as a component of an external additive for a toner, a toner and the complex particle always contact shell particles present on the toner and the complex particle, rollability is not deteriorated, and high flowability as initial characteristics may be ensured. The complex particle having high flowability may be applied as a component of an external additive for a toner. The high flowability may be maintained for a long time because the adhesion strength of the shell particle on the core particle is high and the shell particle is difficult to be detached from the core particle.

Accordingly, the complex particle according to one embodiment has high adhesion strength of the shell particle on the core particle, a satisfactory charge amount and high flowability.

A method of preparing the complex particle, that is a method of preparing a complex particle including a core particle and a shell particle includes a process of forming a particle adhesion body wherein the shell particle is adhered on the surface of the core particle to provide a particle adhesion body, using dispersion liquid including the core particle including one of an organic material and an inorganic material as a main component and the shell particle including the other of the organic material and the inorganic material as a main component, and a process of forming a complex particle wherein a silane coupling agent and a basic material that are bound to one of the core particle and the shell particle and simultaneously interact the other are added to the dispersion liquid including the particle adhesion body and the shell particle is fixed on the surface of the core particle to provide the complex particle.

In the process of forming a particle adhesion body, a particle adhesion body is formed by making the shell particle be present on the core particle by hetero agglomeration, and electrostatically attaching the shell particle to the surface of the core particle, and in the process of forming a complex particle, the complex particle is formed by fixing the shell particle on the surface of the core particle by the silane coupling agent.

The complex particle may have all properties explained above.

Accordingly, according to the method of preparing the complex particle, a complex particle having high adhesion strength of a shell particle on a core particle and a satisfactory charge amount and high flowability may be prepared.

When complex particles are externally added to an electrophotography toner for an and is used as a component of an external additive for a toner, complex particles may get various stresses such as shear force or friction force when contacting members of an image forming apparatus such as a copy machine.

When complex particles are applied to a toner for an electrophotography, a charge amount of complex particles may be controlled within appropriate ranges according to their uses, and a toner for an electrophotography including complex particles needs to be provided with flowability depending on uses.

Complex particles applied to the toner for an electrophotography and the like are required to have sufficient strength and a satisfactory charge amount to endure stress, and in addition, a toner for an electrophotography including complex particles is required to be provided with flowability depending on uses.

Embodiment 1

A. Complex Particle

A complex particle according to the present embodiment includes a core particle and a shell particle. A main component of the core particle is an organic material (hereinafter, the core particle is referred to as an "organic core particle"), and the shell particle is present on the core particle, and a main component of the shell particle is an inorganic material (hereinafter, the shell particle is referred to as an "inorganic shell particle"). The complex particle has the following Properties (1) to (6).

Property (1): An average particle diameter of the organic core particle is greater than or equal to about 80 nm and less than or equal to about 300 nm.

Property (2): A coefficient of variation of an average particle diameter of the organic core particle is greater than or equal to about 2% and less than or equal to about 10%.

Property (3): An average particle diameter of the inorganic shell particle is greater than or equal to about 5 nm and less than or equal to about 30 nm, and simultaneously a ratio of the average particle diameter of the inorganic shell particle relative to the average particle diameter of the organic core particle (hereinafter, referred to as "an average particle diameter of the inorganic shell particle/an average particle diameter of the organic core particle") is greater than or equal to about 0.016 and less than or equal to about 0.25.

Property (4): An average particle diameter of the complex particle is greater than or equal to about 90 nm and less than or equal to about 350 nm.

Property (5): A ratio $\beta_1/\beta_2$ of multipliers in a volume resistance $\rho_v=\alpha_1\cdot10^{\beta1}$ ($\Omega\cdot$cm) and a sheet resistance $\rho_s=\alpha_2\cdot10^{\beta2}$ ($\Omega/cm^2$) of the complex particle is greater than or equal to about 0.7 and less than or equal to about 1.4.

Property (6): A change of the number of the inorganic shell particle present on the organic core particle before and after irradiating an ultrasonic wave to complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%.

As used herein, a dimension of an average particle diameter and the like is referred to as a property.

The organic material of the organic core particle may be a material having a mechanical strength for the organic core particle constituting a particle center of the complex particle. The organic material may be a (meth)acrylic resin, polystyrene, polyolefin such as polyethylene, polyvinylchloride, a polyester such as polyethyleneterephthalate, and a copolymer thereof, an epoxy resin, a urethane resin, but is not limited thereto.

Inorganic materials forming the inorganic shell particle may be selected from inorganic materials of silicon oxide (silica), titanium oxide (titania), zirconium oxide (zirconia), aluminum oxide (alumina), cerium oxide, tungsten oxide, antimony oxide, copper oxide, tellurium oxide, manganese oxide, tin oxide, indium oxide, beryllium oxide, lead oxide, bismuth oxide, barium titanate, strontium titanate, magnesium titanate, silicon nitride, carbon nitride, and the like, considering uses of the complex particle and kinds of organic materials forming the organic core particle. In an embodiment, the inorganic materials forming the inorganic shell particle may be desirably selected from silica, titania, cerium oxide, and strontium titanate, but are not limited thereto.

Herein, shapes of the complex particle, the organic core particle and the inorganic shell particle and a relationship between the organic core particle and the inorganic shell particle are explained.

Figure 2:
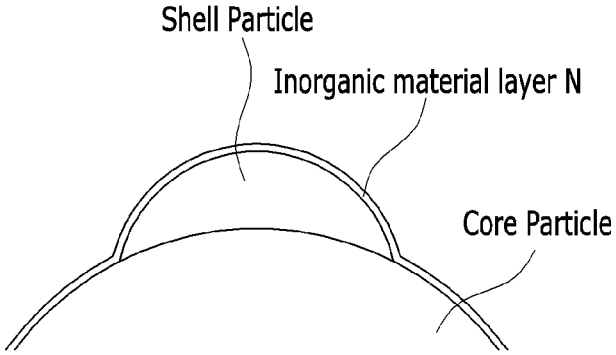
FIG. 2 is an enlarged schematic cross-sectional view showing a part of the surface structure of the complex particle shown in FIG. 1.

FIG. 1 is a schematic view showing appearance of a complex particle based on an image of a SEM and FIG. 2 is an enlarged schematic cross-sectional view showing a part of the surface structure of the complex particle shown in FIG. 1.

Referring to FIG. 1, the complex particle is for example a raspberry shaped particle having a spherical shape as a whole, and one organic core particle A constituting a particle center and having a large particle diameter and a plurality of inorganic shell particles B that are fixed on the surface of the organic core particle A and integrated therewith and having a smaller particle diameter than the organic core particle A.

The organic core particle A and the inorganic shell particles B are prepared by the preparing method that will be explained later and have spherical shape.

As shown in FIG. 1, a plurality of inorganic shell particle B is fixed on the surface of the organic core particle A as it constitutes at least one part of the surface of the organic core particle A. In this shape, a plurality of inorganic shell particle B constituting at least one part of the surface of the organic core particle A is desirably fixed on the entire surface of the organic core particle A uniformly without a bias. If the inorganic shell particle B is biased to a part of the surface of the organic core particle A and is nonuniformly fixed, bias of characteristics of the complex particle may be caused, the spherical shape of the complex particle is not maintained, and flowability required for the complex particle may be deteriorated.

As long as the inorganic shell particle B is not biased on a part of the surface of the organic core particle A, the inorganic shell particle B may be exposed on a part of the surface of the organic core particle A.

Before the shell particle is fixed on the surface of the organic core particle A, organic particles formed of a different kind of the organic material as a main component as shown with C1, C2, C3 . . . Cn (n is an integer of 1 or greater) in FIG. 1 are integrated as a whole to provide one organic core particle in order that the organic core particle A satisfies the condition of the Property (1).

Each particle integrated to constitute one organic core particle may have a different particle diameter.

The Properties (1) to (4) relate to each average particle diameter of the complex particle, the organic core particle A, and the inorganic shell particle B, and average particle diameters thereof may be obtained by SEM image examination.

Hereinafter, a method of obtaining an average particle diameter of the complex particle by SEM image examination is explained.

Figure 3:
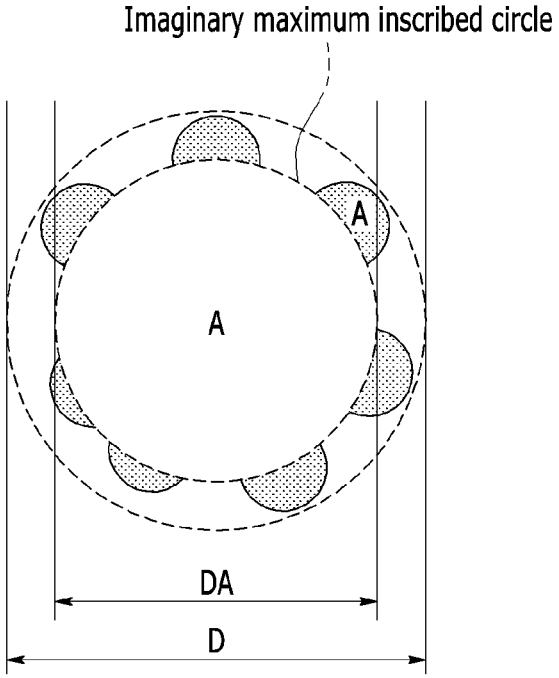
FIG. 3 is a schematic view for explaining an embodiment of a method of obtaining an average particle diameter of the complex particle shown in FIG. 1.
Figure 4:
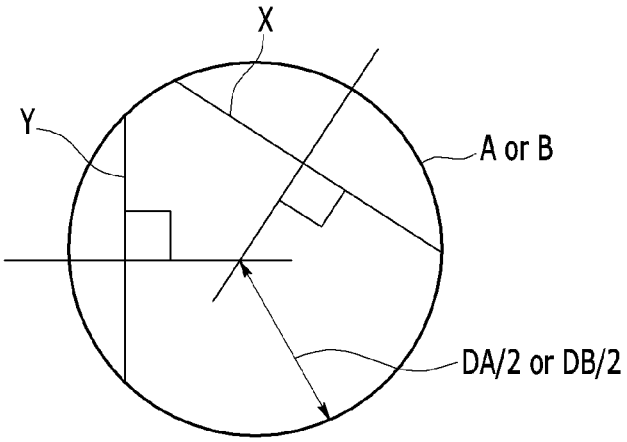
FIG. 4 is a schematic view for explaining a method of obtaining an average particle diameter of a particle constituting a part of the complex particle.

FIG. 3 is a schematic view for explaining a method of obtaining an average particle diameter of the complex particle shown in FIG. 1 and FIG. 4 is a schematic view for explaining a method of obtaining an average particle diameter of a particle constituting a part of the complex particle.

In the SEM image examination, each SEM image for 100 complex particles in total is binarized to obtain each binarized image of the complex particles while changing a view of the SEM image.

Based on the binarized image, as shown in FIG. 3, when a circular outline of the cross section of the complex particle is supposed to be a surface of the organic core particle A, the surface of the organic core particle A may be indicated as an imaginary maximum inscribed circle (marked by an internal dotted line in FIG. 3) having a diameter DA (an average particle diameter of the organic core particle A) of the circular outline. Substantially, circular parts protruding from the imaginary maximum inscribed circle correspond to the inorganic shell particle B present on the surface of the organic core particle A. Accordingly, the farthest circle from the imaginary maximum inscribed circle of substantially circular parts protruding from the imaginary maximum inscribed circle is supposed to correspond to the outer surface of the complex particle, the surface of the complex particle may be indicated as an imaginary maximum circumscribed circle (marked by the outmost dotted line in FIG. 3) having a diameter D (an average particle diameter of the complex particle) of the farthest circle from the imaginary maximum inscribed circle.

An average particle diameter before coupling the organic core particle A and the inorganic shell particle B is obtained as follows.

The average particle diameter is also obtained by SEM image examination, each SEM image for each 100 organic core particle A or inorganic shell particle B in total is binarized to obtain each binarized image of the organic core particle A or the inorganic shell particle B while changing a view of the SEM image.

From the binarized images, the diameter DA of the organic core particle A or the diameter DB of the inorganic shell particle B is obtained.

That is to say, as shown in FIG. 4 based on binarized images, at least two chords X and Y are randomly drawn in a circular part corresponding to the particle surface.

A distance between an intersection point of the two chords X and Y and the farthest point from the intersection point on substantially circular part, corresponds to a radius DA/2 of the organic core particle A or the radius DB/2 of inorganic shell particle B as shown in FIG. 4, and thus from these radii, the diameter DA of the organic core particle A (an average particle diameter of the organic core particle A) or the diameter DB of inorganic shell particle B (an average particle diameter of the inorganic shell particle B) may be obtained.

Hereinafter, Properties (1) to (4) are explained individually.

The numeral range of the average particle diameter of the organic core particle A of the Property (1) may be a desirable particle range of the organic core particle A before fixing the inorganic shell particle B on the organic core particle A when the complex particle is actually used as a component of an external additive for a toner.

The average particle diameter of the organic core particle A may be greater than or equal to about 80 nm and less than or equal to about 300 nm, for example greater than or equal to about 80 nm and less than or equal to about 200 nm as described above.

When the average particle diameter of the organic core particle A is less than about 80 nm, organic core particles having a small particle diameter may be mixed, and thus complex particles including organic core particles having a small particle diameter may not realize, for example, spacer effects required for an external additive for a toner having a large particle diameter.

When the average particle diameter of the organic core particle A is greater than about 300 nm, organic core particles having a very large particle diameter may be mixed, and thus average particle diameters of complex particles including average particle diameters of the inorganic shell particle B is excessively large as a component of an external additive for a toner, and adhesion force of an external additive for a toner to an toner particle may be lowered.

The numeral range of the coefficient of variation of the average particle diameter of the organic core particle A of the Property (2) may be a desirable range of a deviation of an average particle diameter of the organic core particle A before fixing the inorganic shell particle B on the organic core particle A when the complex particle is actually used as a component of an external additive for a toner.

The coefficient of variation may be calculated by a standard deviation of measurement value distribution of a particle diameter of organic core particle A+average particle diameter×100.

Herein, when the coefficient of variation of the average particle diameter of the organic core particle A is greater than about 10%, a deviation of the particle diameter of the organic core particle A is excessively large, adhesion of the complex particle to a toner is not stable, and characteristics of a toner are not stable, when the complex particle is used as a component of an external additive for a toner.

The numeral range of the average particle diameter of the inorganic shell particle B/the average particle diameter of the organic core particle A of the Property (3) may indicate a desirable balance between the average particle diameter of the inorganic shell particle B and the average particle diameter of the organic core particle A before fixing the inorganic shell particle B on the organic core particle A when the complex particle is actually used as a component of an external additive for a toner.

The particle diameter of the inorganic shell particle of the Property (3) is greater than or equal to about 5 nm and less than or equal to about 30 nm, and simultaneously the average particle diameter of the inorganic shell particle B/the average particle diameter of the organic core particle A is greater than or equal to about 0.016 and less than or equal to about 0.25, for example greater than or equal to about 0.018 and less than or equal to about 0.2, as described above.

Herein, when the particle diameter of the inorganic shell particle is less than about 5 nm, it is difficult to exist in a form of a primary particle, and may not be present on the core particle uniformly.

On the contrary, when it is greater than about 30 nm, when the shell particle gets a stress, it may be easily detached and flowability of external additive for a toner may not be ensured.

When the average particle diameter of the inorganic shell particle B/the average particle diameter of the organic core particle A is less than about 0.016, the average particle diameter of the inorganic shell particle B compared with the average particle diameter of the organic core particle A is too small, and size balance between both particles is not good. When the average particle diameter of the organic core particle A is about 80 nm, the complex particle may be difficult to have a sufficiently large particle diameter to realize, for example, a spacer effect.

When the average particle diameter of the inorganic shell particle B/the average particle diameter of the organic core particle A is greater than about 0.25, the average particle diameter of the inorganic shell particle B compared with the average particle diameter of the organic core particle A is too small, and size balance between both particles is not good. When the core particle and the shell particle get stress, they may be easily detached, and flowability of external additive for a toner may be not ensured.

The numeral range of the average particle diameter of the complex particle of Property (4) may be a desirable particle range of an appropriate complex particle when the complex particle is actually used as a component of an external additive for a toner.

The average particle diameter of the complex particle of Property (4) is greater than or equal to about 90 nm and less than or equal to about 350 nm, for example greater than or equal to about 90 nm and less than or equal to about 250 nm as described above.

Herein, when the average particle diameter of complex particle is less than about 90 nm, the complex particle is too small and the complex particle may not realize a spacer effect.

When the average particle diameter of the complex particle is greater than about 350 nm, the complex particle is too large as a component of an external additive for a toner.

Each average particle diameter of the complex particle, the organic core particle A, and the inorganic shell particle B that has an effect on Properties (1) to (4) may be obtained by other methods (for example, dynamic light scattering method) except the SEM image examination.

Even if an average particle diameter of other specific complex particles except the complex particle according to one embodiment obtained by other method except the SEM image examination is different from the numeral ranges of the Properties (1) to (4), the specific complex particles are considered to have the Properties (1) to (4) when an average particle diameter of the specific complex particles obtained by the SEM image examination falls within the numeral ranges of the Properties (1) to (4).

The complex particle having all Properties (1) to (4) has a Property (5) that is a ratio $\beta_1/\beta_2$ of multipliers in a volume resistance $\rho_v=\alpha_1\cdot10^{\beta1}$ ($\Omega\cdot$cm) and a sheet resistance $\rho_s=\alpha_2\cdot10^{\beta2}$ ($\Omega/cm^2$) of the complex particle of greater than or equal to about 0.7 and less than or equal to about 1.4 as described above.

Herein, the ratio of the multipliers $\beta_1/\beta_2$ may be referred as a resistance ratio $\rho_r$.

The $\alpha_1$ and $\alpha_2$ are a real number of greater than or equal to about 1 and less than about 10, $\beta_1$ and $\beta_2$ are an integer of greater than or equal to about 0 and less than or equal to about 20, and $\alpha_1$, $\alpha_2$, $\beta_1$, $\beta_2$ may independently the same or different numerals.

The numeral range of the resistance ratio $\rho_r$ of the complex particle of the Property (5) indicates a desirable balance between a volume resistance $\rho_v$ of the complex particle and a sheet resistance $\rho_s$ of the complex particle when the complex particle is actually used as a component of an external additive for a toner.

The volume resistance $\rho_v$ of the complex particle depends on electrical resistances of an organic material of the organic core particle A and an inorganic material of the shell particle B, and the sheet resistance $\rho_s$ of the complex particle depends on a specific electrical resistance of a material forming the surface of the complex particle.

Accordingly, the resistance ratio $\rho_r$ is determined by balance between both resistances. When a balance between the volume resistance $\rho_v$ of the complex particle and the sheet resistance $\rho_s$ of the complex particle is appropriate, and the resistance ratio $\rho_r$ falls within the above numeral range, charges on the complex particle transport from the whole surface of the complex particle to another particle uniformly, and thus the complex particle has good charge characteristics such as a charging rate, a charge amount (μC/g) and stability.

The volume resistance $\rho_v$ and the sheet resistance $\rho_s$ of the complex particle of the Property (5) satisfy $\beta_1/\beta_2$ of greater than or equal to about 0.7 and less than or equal to about 1.4 as described above.

In the complex particle, the volume resistance $\rho_v$ depends on each electrical resistances of an organic material of the organic core particle A and an inorganic material of the shell particle B, and the sheet resistance $\rho_s$ depends on a specific electrical resistance of a material forming the surface of the complex particle.

The electrical resistance of the inorganic material of the inorganic shell particle B is lower than the organic material of the organic core particle A, and thus, in the complex particle having the above structure, the volume resistance $\rho_v$ is high and the sheet resistance $\rho_s$ is low.

Generally, charges on a particle surface are considered to enter inside the particle or transport from another surface of the particle (for example, a contact face of the complex particle with an externally added toner particle) to another particle along the particle surface.

In the complex particle including the organic core particle A and the inorganic shell particle B, because charges on the surface does not enter inside the complex particle (a part of the organic core particle A), and externally leaks at the surface of the complex particle (a surface part of the inorganic shell particle B), surface charges of the complex particle are small and inside charges of the complex particle become large, and uniformity of charges of the complex particle are damaged.

Therefore, a relationship between the volume resistance $\rho_v$ and the sheet resistance $\rho_s$ of the Property (5) is required to fall within an appropriate numeral range.

Herein, when the resistance ratio $\rho_r$ is less than about 0.7, the sheet resistance $\rho_s$ of the complex particle relative to the volume resistance $\rho_v$ is too small, surface charges of the complex particle may leak externally, and a charge amount of the complex particle is not maintained within an appropriate range.

When the resistance ratio $\rho_r$ is greater than about 1.4, the sheet resistance $\rho_s$ of the complex particle relative to the volume resistance $\rho_v$ is too small, excessive charges on the surface of the complex particle may be produced, image degradation may be caused, charge uniformity of the complex particle may be damaged due to external leak of surface charges, and a charge amount of the complex particle may be maintained within an appropriate range when the complex particle is used as a component of an external additive for a toner.

Herein, a method of measuring the volume resistance $\rho_v$ of the complex particle (Ω·cm) and the sheet resistance $\rho_s$ (Ω/cm$^2$) required to obtain the resistance ratio $\rho_r$ of the complex particle is explained.

Figure 5:
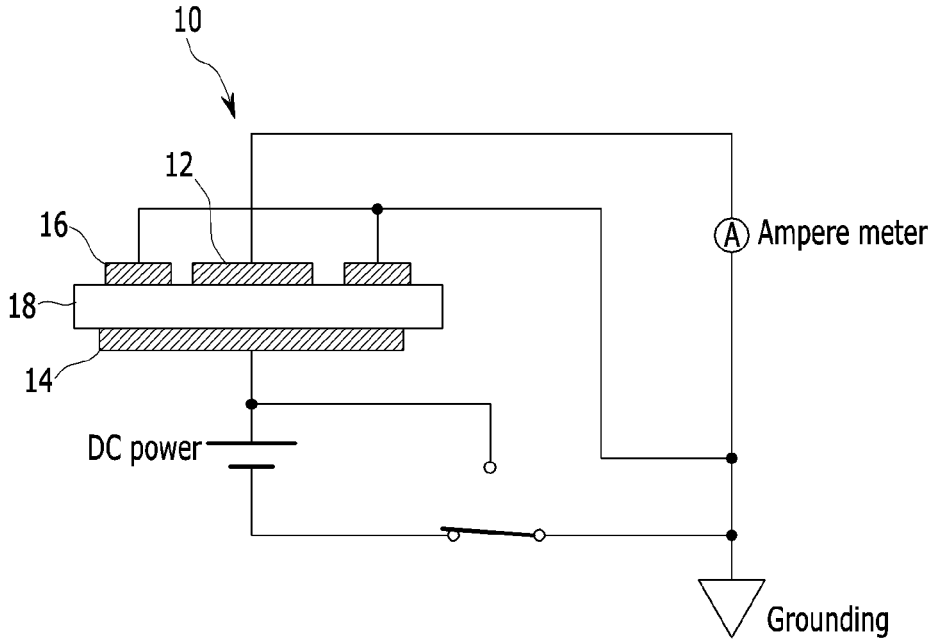
FIG. 5 is an embodiment of a circuit diagram for measuring a volume resistance of a complex particle.
Figure 6:
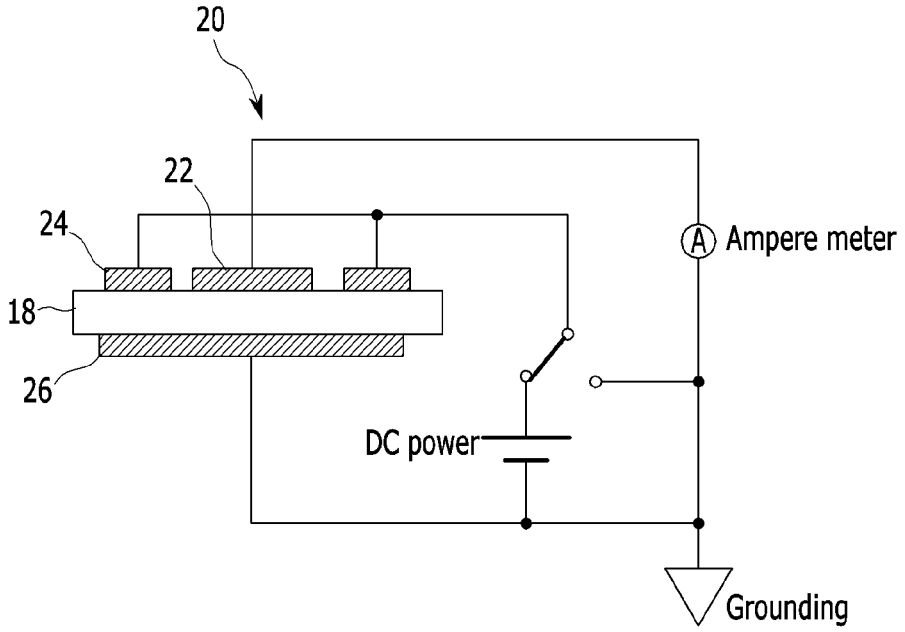
FIG. 6 is an embodiment of a circuit diagram for measuring a sheet resistance of a complex particle.

FIG. 5 is a circuit diagram for measuring a volume resistance of a complex particle and FIG. 6 is a circuit diagram for measuring a sheet resistance of a complex particle.

<Measurement of Volume Resistance>

First, the complex particle and a thermosetting epoxy resin are added to methanol, and the complex particle is dispersed in the thermosetting epoxy resin and then kneaded to obtain a kneaded product.

Then, the kneaded product is crushed with a mortar and a pestle for a predetermined time to obtain a gel-type material.

The obtained gel-type material flows in a mold and is pressed, the molded product is dried, obtaining a pellet formed of a composite material of the complex particle and the epoxy resin.

A main electrode 12 is mounted on one side of the pellet (test specimen) 18 and a counter electrode 14 is mounted on the rear side using each silver (Ag) paste, and a guard electrode 16 is mounted surrounding the main electrode 12 on the side mounted with the main electrode 12 using a silver paste to provide a circuit 10 for measuring a volume resistance shown in FIG. 5 and to measure the volume resistance of the pellet 18.

The volume resistance (Ω·cm) of the complex particle is calculated by performing the same measurement while changing a composition ratio of the complex particle and the epoxy resin of the pellet 18, obtaining a calibration curve based on changes of the volume resistance depending on a ratio of the epoxy resin, and obtaining an intercept (a volume resistance when the ratio of the epoxy resin is 0%) of a coordinate axis of the calibration curve.

<Measurement of Sheet Resistance>

The sheet resistance is measured using the same pellet 18.

A main electrode 22 and a counter electrode 24 are mounted on one side of the pellet 18, and a guard electrode is mounted on the rear side of the pellet 18 using each silver paste to provide a circuit 20 for measuring a sheet resistance shown in FIG. 6.

The sheet resistance (Ω/cm$^2$) of the complex particle is also calculated by performing the same measurement while changing a composition ratio of the complex particle and the epoxy resin of the pellet 18, obtaining a calibration curve based on changes of the sheet resistance depending on a ratio of the epoxy resin, and obtaining an intercept (a sheet resistance when the ratio of the epoxy resin is 0%) of a coordinate axis of the calibration curve.

The resistance ratio $\rho_r$ of the complex particle of the Property (5) may be obtained by other methods except the measurement methods using circuits 10 and 20 shown in FIGS. 5 and 6.

Even if a resistance ratio $\rho_r$ of other specific complex particles except the complex particle according to one embodiment obtained by other method except the measurement method using circuits 10 and 20 shown in FIGS. 5 and 6 is different from the numeral range of the Property (5), the specific complex particles are considered to have the Property (5) when a resistance ratio $\rho_r$ of the specific complex particles obtained by the measurement method using circuits 10 and 20 shown in FIGS. 5 and 6 falls within the numeral ranges of the Property (5).

When the resistance ratio $\rho_r$ of the complex particle of the Property (5) falls within the numeral range, the complex particle has good charge characteristics such as a charging rate, a charge amount (μC/g) and stability.

A satisfactory charge amount of the complex particle may be greater than or equal to about −300 and less than or equal to about −100, for example greater than or equal to about −250 and less than or equal to about −150.

The charge amount of the complex particle is measured as follows.

First, in a plastic vessel with a cap, a ferrite particle coated with a styrene/methyl methacrylate resin is measured, and then a complex particle is measured while being mounted on the ferrite particle.

Then, the resultant is allowed to stand at room temperature under normal humidity (23° C./50% RH) and seasoned for 24 hours, and stirred with a tubular mixer for 3 minutes to apply a load to the complex particle, generating generate a friction charge by colliding the complex particle with the ferrite particle.

The charge amount (μC/g) of the complex particle is measured by using an electric field ratio equation-based charge amount measurement device (Product name: II-DC electric field, Manufacturer: DIT Co., Ltd.).

The complex particle having the Properties (1) to (5) has the Property (6) wherein a change of the number of the inorganic shell particle B present on the organic core particle A before and after irradiating an ultrasonic wave to complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%, as described above.

The numeral range of the change of the number of the inorganic shell particle B fixed on the surface of the organic core particle A before and after irradiating an ultrasonic wave of Property (6) may indicate a desirable adhesion strength of the inorganic shell particle B on the organic core particle A when the complex particle is actually used as a component of an external additive for a toner.

The change of the number of the Property (6) is greater than or equal to about 0.5% and less than or equal to about 5%, as described above.

Herein, when the change of the number is greater than about 5%, an adhesion strength of the inorganic shell particle B on the organic core particle A is low, the inorganic shell particle B may be easily detached to cause toner degradation and image degradation when the complex particle is used as a component of an external additive for a toner.

Herein, the change of the number of the Property (6) is obtained as follows.

First, 100 complex particles in a dry state are examined through a SEM image to count the inorganic shell particles B on the surface of the organic core particle A (the number of shell particles before radiating an ultrasonic wave).

On the other hand, complex particle dispersion liquid is prepared by dispersing the same complex particle as above in a ratio of 1 wt % in water.

The complex particle dispersion liquid is radiated by an ultrasonic wave for 30 minutes under a condition of a power of 110 W and a frequency of 31 kHz.

Subsequently, the complex particle dispersion liquid is centrifugally sedimented to separate solid-liquid, and a sediment is separately collected and then, dried.

Among the dried solids, 100 complex particles are examined through a SEM image to count the inorganic shell particles B on the organic core particle A (the number of shell particles after radiating the ultrasonic wave).

The numbers of the shell particles before and after radiating the ultrasonic wave are used to obtain a change (%) of the inorganic shell particles B before and after irradiating the ultrasonic wave.

In the measurement of the change of the number of the Property (6), the complex particle dispersion liquid being subject to irradiation of ultrasonic wave of a power of 110W and a frequency of 31 kHz is aqueous dispersion liquid including 1 wt % of the complex particle and an irradiation time of the ultrasonic wave is about 30 minutes as described above.

The power, the frequency, and the irradiation time of the ultrasonic wave are determined to apply a load corresponding to a stress of a shear force to the complex particle when the complex particle is used as a component of an external additive for a toner.

An amount of the complex particle in aqueous dispersion liquid including about 1 wt % of the complex particle dispersion liquid is determined so that the complex particle may not be dense, the complex particle may not be rare, and irradiation efficiency may not be prevented.

Therefore, obtaining the change of the number under the above measurement condition corresponds to a substantial durability test, and an adhesion strength of the inorganic shell particle B on the organic core particle A may be known relatively and accurately in a short time when the complex particle is used as a component of an external additive for a toner.

In addition, the change of the number of the Property (6) may be obtained by combining a durability test except the durability test by the ultrasonic wave irradiation (for example, a durability test by stirring using a tubular mixer which will be described later) and a method except the SEM image examination (for example, a method by microscope examination using a TEM image).

Even if a change of the number of other specific complex particles except the complex particle according to one embodiment obtained by other method except a combining method of a durability test except the durability test by the ultrasonic wave irradiation and a method except the SEM image examination is different from the numeral range of Property (6), the specific complex particles are considered to have the Property (6) when a change of the number of the specific complex particles obtained by the measurement method using the durability test by irradiation of an ultrasonic wave and the SEM image examination falls within the numeral ranges of the Property (6).

The complex particle having all the Properties (1) to (6) has a relative permittivity of greater than or equal to about 2 and less than or equal to about 300 (hereinafter, Property (7)).

The numeral range of the Property (7) is an actually appropriate relative permittivity of the complex particle when the complex particle is used as a component of an external additive for a toner.

The relative permittivity of the complex particle is a ratio of a dielectric constant of the complex particle relative to a vacuum dielectric constant.

That is, when the vacuum dielectric constant is $\varepsilon_0$ and the dielectric constant of the complex particle is $\varepsilon$, relative permittivity $\varepsilon_r$ of the complex particle satisfies a relationship of $\varepsilon/\varepsilon_0=\varepsilon_r$.

The relative permittivity of the complex particle changes depending on changes of the volume resistance $\rho_v$ and the sheet resistance $\rho_s$ of the complex particle.

The relative permittivity of the Property (7) is greater than or equal to about 2 and less than or equal to about 300, for example greater than or equal to about 2 and less than or equal to about 200 as described above.

Herein, when the relative permittivity is less than about 2, the complex particle has high insulation properties and thus a charge amount of the complex particle decreases.

When the relative permittivity is greater than about 300, the complex particle has relatively high conductivity, and charges may leak.

The dielectric constant $\varepsilon$ of the complex particle required for the relative permittivity $\varepsilon_r$ of the complex particle may be obtained using a pellet used for measuring the volume resistance and the sheet resistance, for example, using a dielectric constant measuring device (E4991A RF impedance/material (raw materials) analyzer, Keysight Technologies) as follows.

A dielectric constant is measured with the dielectric constant measuring device by changing a ratio between the complex particle and an epoxy resin in the above pellet, a calibration curve based on a dielectric constant change according to the ratio of the epoxy resin is obtained, and an intercept (a dielectric constant when the epoxy resin ratio is 0%) of a coordinate axis with the calibration curve is obtained as the dielectric constant $\varepsilon$ (F/m) of the complex particle.

Then, a ratio (relative permittivity of the complex particle: $\varepsilon_r=\varepsilon/\varepsilon_0$) of the dielectric constant $\varepsilon$ of the complex particle relative to the dielectric constant $\varepsilon_0$ of vacuum (about $8.854\times10^{-12}$ F/m) is calculated.

The relative permittivity of the Property (7) may be obtained by combining a pellet except the pellet used for measurement of the volume resistance and the sheet resistance and a device except the dielectric constant measuring device.

Even if relative permittivity of other specific complex particles except the complex particle according to one embodiment obtained by combining a pellet except the pellet and a device except the device is different from the numeral range of the Property (7), the specific complex particles are considered to have the Property (7) when relative permittivity of the specific complex particle obtained by combining the pellet and the device falls within the numeral ranges of the Property (7).

The complex particle having all the Properties (1) to (6), or the complex particle having all the Properties (1) to (7) has a coating ratio of the shell particle on the surface of the core particle of is greater than or equal to about 5% and less than about 68% (hereinafter, Property (8)).

The coating ratio of the Property (8) may be greater than or equal to about 5% and less than about 68%, for example greater than or equal to about 5% and less than or equal to about 50%.

Herein, when the coating ratio is less than about 5%, a shape of protrusions and depressions by the inorganic shell particle B on the surface of the complex particle, that is, the surface of the organic core particle A is not sufficient, thus the contact numbers of the organic core particle A of other complex particles with a toner surface increases as the complex particle rolls, and flowability of the complex particle is not sufficient when the complex particle is used as a flowability improving agent of an external additive for a toner.

When the coating ratio is greater than about 68%, the inorganic shell particles B on the surface of the organic core particle A overlap, they do not contact the surface of the organic core particle A, and adhesion strength of the inorganic shell particles B overlapping on the inorganic shell particles B may be deteriorated, may be easily detached, and a powder may be produced.

The coating ratio of the Property (8) may be obtained by the SEM image examination.

First, SEM images for 100 complex particles in total are obtained while changing a view of the SEM image as in measurement of the average particle diameter.

Then, a square region for a projection image of the complex particle of the obtained SEM images is set, a coating area of the inorganic shell particle B on the surface of the organic core particle A in the region is obtained, and then a coating ratio (%) of the inorganic shell particle B relative to an area of the region is obtained.

The coating ratio of the Property (8) may be obtained by other methods except the SEM image examination.

Even if a coating ratio $\rho_r$ of other specific complex particles except the complex particle according to one embodiment obtained by other method except the SEM image examination is different from the numeral range of the Property (8), the specific complex particles are considered to have the Property (8) when a coating ratio of the specific complex particles obtained by the SEM image examination falls within the numeral ranges of the Property (8).

The complex particle having all the Properties (1) to (6), or the complex particle having the Property (7) or the Property (8) in addition to the Properties (1) to (6) may further include an inorganic material layer N coating the surface of the organic core particle A and the surface of the inorganic shell particle B, as shown in FIG. 2.

The inorganic material layer N interacts the organic core particle A and may be formed by bonding (condensation) with a hydroxy group (OH group) on the surface of the inorganic shell particle B under a basic condition.

Such a material may be a silane coupling agent, and the hydroxy group (OH group) on the surface of the inorganic shell particle B and the silane coupling agent form a network structure under a basic condition, and an inorganic material layer N including silicon (Si) there inside having a structure similar to an amorphous structure of silica is formed.

In this way, the inorganic material layer N has a network structure coating the surface of the organic core particle A and the surface of the inorganic shell particle B, adhesion strength of the inorganic shell particle B on the organic core particle A increases. The inorganic material layer N has electrical resistance equivalent to a passivation film formed of an inorganic material such as silica due to a structure similar to an amorphous structure of silica including silicon (Si). Therefore, it may control balance between the volume resistance $\rho_v$ and the sheet resistance $\rho_s$ of the complex particle.

The silane coupling agent that is useable for forming inorganic material layer N may be a compound represented by formula $R^1$—$Si(OR^2)_3$ (wherein, $R^1$ is a C1 to C6 hydrocarbon group including either one of oxygen and nitrogen or both of them or a C1 to C18 hydrocarbon group without oxygen and nitrogen, and $R^2$ is a C1 to C6 monovalent hydrocarbon group), and capable of forming a silicon-containing network structure.

Specifically, the silane coupling agent useable for forming the inorganic material layer N may be 3-(trimethoxysilyl) propyl methacrylate (MAPTMS), acrylic acid 3-(trimethoxysilyl)propyl, vinyltriethoxysilane, vinyltrimethoxysilane, hexyl triethoxysilane, octyl triethoxysilane, decyl triethoxysilane, octadecyltriethoxysilane, 3-ureidopropyltriethoxysilane, aminopropyltriethoxysilane, triethoxy (3-(glycidyloxypropyl)silane, 3-isocyanatopropyltriethoxysilane, and the like, but is not limited thereto.

Such a silane coupling agent may be appropriately selected from organic materials forming the organic core particle A.

For example, when the organic material of the organic core particle A is an acrylic resin or a methacrylic resin, a silane coupling agent having a reactive bonding group (for example, alkoxy group such as a methoxy group) capable of interacting a functional group of the acrylic resin or the methacrylic resin may be selected.

When the organic material is a polyester resin, a silane coupling agent having a reactive bonding group (isocyanate group) capable of interacting a functional group of the polyester resin may be selected.

When the organic material is an epoxy resin, a silane coupling agent having a reactive bonding group (epoxy group) capable of interacting a functional group of the epoxy resin may be selected.

When the organic material is a urethane resin, a silane coupling agent having a reactive bonding group (urethane group) capable of interacting a functional group of the urethane resin may be selected.

Herein, the interacting is different depending on a kind of the organic material, it may depend on affinity of a functional group of the organic material and a reactive bonding group of the silane coupling agent, and refers to intermolecular forces sufficient for forming a network structure and maintaining it.

The basic condition may have pH of greater than or equal to about 8 and less than or equal to about 13, for example greater than or equal to about 8 and less than or equal to about 12.

Basic materials providing the basic condition may be ammonia, sodium hydroxide, potassium hydroxide, and the like, but are not limited thereto.

The complex particle having the above properties according to the Embodiment 1 is prepared by making positively charged inorganic shell particles B be present on a negatively charged organic core particle A by hetero agglomeration, and then electrostatically attaching the both particles. A particle adhesion body is obtained by coupling and integrating the inorganic shell particles B on the surface of the organic core particle A and the inorganic material layer N formed of the silane coupling agent coats the surface of the organic core particle A and the surface of the inorganic shell particle B to fix the inorganic shell particles B on the surface of the organic core particle A.

Examples corresponding to such a complex particle are Examples 1-1 to 1-17, which will be described later.

In this way, the negatively charged organic shell particles are present on the surface of the positively charged organic core particle A as a whole by hetero agglomeration and then electrostatically attached to each other.

Then a particle adhesion body is obtained by coupling and integrating the inorganic shell particles B and organic shell particles on the surface of the organic core particle A, and coating organic each surface of the core particle A, the inorganic shell particles B and the organic shell particles with the inorganic material layer N formed of the silane coupling agent to form the complex particle including the inorganic shell particles B and the organic shell particles on the surface of the organic core particle A.

That is, the complex particle is formed by integrating the inorganic shell particles B and the organic shell particles (not shown) present on the surface of the organic core particle A with the organic core particle A.

Examples corresponding to such a complex particle are Examples 3-1 to 3-6, which will be described later.

B. Method of Preparing Complex Particle

The method of preparing the complex particle including the organic core particle A and the inorganic shell particle B includes a process of forming a particle adhesion body and a process of forming a complex particle.

The preparing method is one of methods of preparing complex particles having properties explained in the above A.

Hereinafter, each process is explained.

1. Forming Process of Particle Adhesion Body

The process of forming a particle adhesion body is a process of forming a particle adhesion body including the inorganic shell particle B on the surface of the organic core particle A using dispersion liquid (hereinafter, organic/inorganic particle dispersion liquid) including the organic core particle A and the inorganic shell particle B.

The particle adhesion body is an intermediate product before preparing a complex particle obtained by the following process of forming a complex particle.

First, before the process of forming a particle adhesion body, organic/inorganic particle dispersion liquid is prepared as follows.

In order to prepare the organic/inorganic particle dispersion liquid, the organic core particle A and the inorganic shell particle B are formed individually.

(A) Formation of Organic Core Particle A

The organic core particle A is formed through each step of (i) preparation of a raw material of an organic core particle A, (ii) synthesis of the organic core particle A, and (iii) removal of reaction residues as explained below.

(i) Preparation of Raw Material of Organic Core Particle A

As raw materials, a starting material of an organic material forming the organic core particle A, a combination auxiliary agent, a reaction initiator, and a particle diameter controlling agent are prepared.

The starting material of the organic material may be a monomer or an oligomer of the organic material as explained in A.

When the organic material is an acrylic resin material, the starting material may be a monomer or oligomer having an alkoxy group such as methyl methacylate (MMA), isobomyl (meth)acrylate, benzyl(meth)acrylate, hydroxyethyl(meth) acrylate, and butyl(meth)acrylate, but is not limited thereto.

The alkoxy group of the starting material may be a methoxy group, an ethoxy group, a propoxy group, and the like, but is not limited thereto.

When the organic material is an acrylic resin material, the combination auxiliary agent may be a monomer or oligomer having an alkoxy group such as 3-(trimethoxy silyl)propyl methacrylate (hereinafter, referred to MAPTMS), 3-(trimethoxysilyl)propyl acrylate, 3-(triethoxysilyl)propyl acrylate, allyl trimethoxysilane, allyl triethoxysilane, vinyltrimethoxysilane, and vinyltriethoxysilane, but is not limited thereto.

The alkoxy group of the combination auxiliary agent may be a methoxy group, an ethoxy group, a propoxy group, and the like, but is not limited thereto.

When the organic material is an acrylic resin material, a reaction initiator may be potassium persulfate (hereinafter, referred to as KPS), sodium persulfate, azobisisobutyronitrile, and the like, but is not limited thereto.

The particle diameter controlling agent may be sodium p-styrene sulfonate (hereinafter, referred to as NaSS), ammonium p-styrene sulfonate, and the like, but is not limited thereto.

(ii) Synthesis of Organic Core Particle A

The organic core particle A is synthesized using the prepared starting materials.

For example, a predetermined amount of water is added to a reaction vessel including a condenser, a thermometer, and a nitrogen inlet, and then, oxygen in the reaction vessel is removed by exchanging an atmosphere in the reaction vessel with a nitrogen gas atmosphere.

Subsequently, MMA, NaSS, and MAPTMS are added thereto and stirred, a predetermined amount of KPS is added to the mixed solution, a polymerization reaction of MMA and MAPTMS in the mixed solution is performed, MMA is cross-linked by MAPTMS, and a polymethyl methacylate (hereinafter, referred to PMMA) particle having a controlled particle diameter is synthesized to obtain dispersion liquid including PMMA particles dispersed therein.

In the reaction system, each amount of the water, MMA, MAPTMS, and KPS is determined considering a mechanical strength required for the organic core particle A, and an amount of the NaSS is determined considering a particle diameter required for the organic core particle A.

A temperature of the polymerization reaction may be greater than or equal to about 0° C. and less than or equal to about 150° C., for example greater than or equal to about 25° C. and less than or equal to about 80° C.

A time of the polymerization reaction may be greater than or equal to about 15 minutes and less than or equal to about 24 hours, for example greater than or equal to about 1 hour and less than or equal to about 16 hours.

(iii) Removal of Reaction Residues in Dispersion Liquid

The PMMA particle in the dispersion liquid is for example subject to a series of repetitive operation of centrifugal sedimentation to separate solid-liquid, decantation of a supernatant, and addition of a predetermined amount of distilled water to remove reaction residues, and a predetermined amount of water is finally added thereto, obtaining PMMA particle (organic core particle A) aqueous dispersion liquid.

(B) Formation of Inorganic Shell Particles B

The inorganic shell particle B is formed through each step of (i) preparation of a raw material of an inorganic shell particle B, (ii) preparation of a silicon-containing component, and (iii) synthesis of the inorganic shell particle B and removal of reaction residues.

(i) Preparation of Raw materials of Inorganic Shell particles B

As a raw material, a starting material of the inorganic material of the inorganic shell particle B, an organic solvent, and a catalyst are prepared.

A starting material of the inorganic material may be a compound including an inorganic material (for example, silicon, titanium, zirconium, or aluminum) explained in A.

When the inorganic material is silica, the starting material may be, for example, silane compounds represented by formula: $R^2R^3Si(OR^1)_2$, formula: $R^2Si(OR^1)_3$, formula: $Si(OR^1)_4$ (in formulae, each $R^1$ is a C1 to C6 monovalent hydrocarbon group, and $R^2$ and $R^3$ are respectively a C1 to C20 hydrocarbon group), and hydrolysis condensation products thereof.

The silane compounds may be tetramethoxysilane, tetraethoxysilane, methyl trimethoxysilane, methyl triethoxysilane, dimethyldimethoxysilane, tetraethoxysilane, dimethyldiethoxysilane, ethyl trimethoxysilane, isobutyl trimethoxysilane, propyl methyldiethoxysilane, propyl trimethoxysilane, phenyl trimethoxysilane, diphenyldimethoxysilane, diphenyldiethoxysilane and the like silane compound (monomer component), but are not limited thereto.

A hydrolysis condensation product of the silane compound may be a hydrolysis condensation product (dimer, oligomer, and the like) obtained by a condensation of a hydrolytic group (a methoxy group, an ethoxy group, and the like) of the silane compound, but is not limited thereto.

The organic solvent may be a protic solvent, an aprotic solvent, and the like, but is not limited thereto.

The protic solvent may be ethanol, 1-propanol, 2-propanol, and the like.

The aprotic solvent may be acetonitrile, acetone, methylisobutylketone, methylethylketone, toluene, and the like.

The catalyst may be a basic compound such as ammonia, dimethyl amine, diethyl amine, trimethyl amine, sodium hydroxide, and potassium hydroxide, but is not limited thereto.

(ii) Preparation of Silicon-Containing Component

A component (hereinafter, referred to as a silicon-containing component) including the silane compound or hydrolysis condensation product (hereinafter, referred to as organosilicon compound) and a component including a catalyst (hereinafter, referred to as a catalyst-containing component) as starting materials are prepared individually.

First, a predetermined amount of the organosilicon compound is mixed with an organic solvent to prepare a silicon-containing component.

A predetermined amount of a basic compound is mixed with a solvent to prepare a catalyst-containing component.

Each amount of the organosilicon compound and the organic solvent in the silicon-containing component is determined considering mechanical strength required for the inorganic shell particle B, and each amount of the basic compound and the solvent in the catalyst-containing component is determined considering an amount of the silicon-containing component.

(iii) Synthesis of Inorganic Shell particle B and Removal of Reaction Residues

First, a liquid temperature of the prepared silicon-containing component is controlled and simultaneously stirred.

On the other hand, when a liquid temperature of a catalyst-containing component reaches the liquid temperature of the silicon-containing component by controlling the liquid temperature, the catalyst-containing component is added to the silicon-containing component at one time and mixed therewith.

Subsequently, the mixed solution including both of the components is stirred and then, heated and concentrated, until the amount of the mixed solution becomes a half.

Then, for example, a series of operation of separating a solid-liquid through centrifugal sedimentation, decantating a supernatant therefrom, and adding a predetermined amount of distilled water thereto is repeated, a predetermined amount of water is finally added thereto, and a reaction residue is removed therefrom, obtaining a dispersion liquid in which silica shell particles (inorganic shell particles B) are dispersed.

Each mixing amount of the silicon-containing component and the catalyst-containing component in a reaction system is determined considering mechanical strength and the like required for the inorganic shell particle B.

The reaction is performed at a temperature ranging from greater than or equal to about 0° C. to less than or equal to about 100° C., for example, greater than or equal to about 15° C. to less than or equal to about 80° C.

In addition, the reaction is performed for greater than or equal to about 1 and less than or equal to about 24, for example, greater than or equal to about 2 hours and less than or equal to about 12 hours.

<Formation of Particle Adhesion Body>

A particle adhesion body is formed by (i) preparing an organic/inorganic particle dispersion liquid by using the organic core particle A synthesized as described above and the inorganic shell particle B synthesized as described above, (ii) stirring the organic/inorganic particle dispersion liquid, (iii) adjusting pH of the organic/inorganic particle dispersion liquid, and (iv) attaching the particles.

(i) Preparation of Organic/inorganic Particle Dispersion Liquid

First, the organic/inorganic particle dispersion liquid is prepared by mixing and stirring a dispersion liquid including the organic core particle A (for example, a PMMA core particle) and another dispersion liquid including the inorganic shell particle B (for example, silica shell particles) in a reaction vessel.

Each mixing ratio of the organic core particle A and the inorganic shell particle B in the organic/inorganic particle dispersion liquid and a mixing ratio of both of the particles are based on the relationship of the average particle diameters of the organic core particle A and the inorganic shell particle B and determined considering a selected number of the shell particle B attached on the surface of the organic core particle A and the like.

The organic/inorganic particle dispersion liquid is prepared at a liquid temperature ranging from greater than or equal to about 0° C. and less than or equal to about 100° C. for example, greater than or equal to about 15° C. and less than or equal to about 80° C.

(ii) Stirring of Organic/Inorganic Particle Dispersion Liquid

Subsequently, the organic/inorganic particle dispersion liquid is stirred at a predetermined liquid temperature for predetermined time, if necessary.

The stirring sufficiently disperses the organic core particle A and the inorganic shell particle B in a neutral zone in the organic/inorganic particle dispersion liquid, gives a contact opportunity to both of the particles, and makes many inorganic shell particles B present on the surface of the organic core particle A.

During the stirring, the organic core particle A and the surface of the inorganic shell particle B, both particles are negatively charged and thus not electrostatically combined.

During the stirring, the dispersion liquid has a liquid temperature of greater than or equal to about 0° C. and less than or equal to 100° C., for example greater than or equal to about 15° C. and less than or equal to about 80° C. for greater than or equal to about 0 hour and less than or equal to about 24 hours for example, for greater than or equal to about 15 minutes and less than or equal to about 15 hours.

(iii) pH Adjustment of Organic/Inorganic Particle Dispersion Liquid

Subsequently, an acid solution is added to the organic/inorganic particle dispersion liquid in a dropwise fashion until the inorganic material of the inorganic shell particle B in the dispersion liquid reaches an isoelectric point of an inorganic material forming the inorganic shell particle B (as for silica, pH 2.0) by continuously checking the pH, while the liquid temperature and the stirring speed are maintained.

The pH adjustment decreases the dispersion liquid from the neutral zone to the isoelectric point (as for silica, pH 2.0), the surface of the inorganic shell particle B in the dispersion liquid is negatively charged from the neutral zone to an acid zone of around pH 2 but positively charged at less than or equal to the isoelectric point.

On the other hand, the surface of the organic core particle A in the dispersion liquid keeps being negatively charged from the neutral zone to less than or equal to the isoelectric point of the inorganic material.

Accordingly, when the dispersion liquid has pH at the isoelectric point, the organic core particle A and the inorganic shell particle B are reversely charged, easily agglomerated each other, and thus, electrostatically adhered each other.

The acid solution may be hydrochloric acid, sulfuric acid, nitric acid, acetic acid, and the like, but is not limited thereto.

(iv) Adhesion

Subsequently, the organic/inorganic particle dispersion liquid is heated up to a predetermined liquid temperature, stirred for predetermined time at the predetermined liquid temperature, forming the particle adhesion body having the inorganic shell particles B (for example, silica shell particles) on the surface of the organic core particle A (for example, a PMMA core particle).

During the adhesion, the particle adhesion body is formed by making the inorganic shell particles B (for example, silica shell particles) be present on the surface of the organic core particle A through a hetero agglomeration and by electrostatically adhering the inorganic shell particle B positively charged during the pH adjustment to the surface of the organic core particle A negatively charged.

The liquid temperature may be in a range of greater than or equal to about 0° C. and less than or equal to about 100° C. for example, greater than or equal to about 15° C. and less than or equal to about 80° C.

The stirring is performed for greater than or equal to about 0 hour and less than or equal to about 24 hours for example, greater than or equal to about 5 minutes and less than or equal to about 12 hours.

2. Process of Forming Complex Particle

A process of forming a complex particle is to form a complex particle by adding a silane coupling agent interacting a reactive bonding group on the surface of the organic core particle A in the dispersion liquid including the particle adhesion body and bonding a hydroxy group (an OH group) on the surface of the inorganic shell particle B under a basic condition, and a basic material, and by coating an inorganic material layer N obtained by the silane coupling agent the surface of the organic core particle A and the surface of the inorganic shell particle B to fix inorganic shell particle B on the surface of the organic core particle A.

Herein, the reactive bonding group may be, for example a hydroxy group, a carboxyl group, an urethane group, an alkoxy group such as a methoxy group, but is not limited thereto.

This process of forming a complex particle improves electrostatic adhesion of the inorganic shell particle B present on the organic core particle A through a hetero agglomeration in the process of forming a particle adhesion body on the organic core particle A and also, adhesion strength of the inorganic shell particle B on the inorganic shell particle B by fixing the inorganic shell particle B on the organic core particle A due to the inorganic material layer N formed by the silane coupling agent.

The silane coupling agent that is useable for forming inorganic material layer N may be a compound represented by formula $R^1$—$Si(OR^2)_3$ (wherein, $R^1$ is a C1 to C6 hydrocarbon group including either one of oxygen and nitrogen or both of them or a C1 to C18 hydrocarbon group without oxygen and nitrogen, and $R^2$ is a C1 to C6 monovalent hydrocarbon group), and capable of forming a silicon-containing network structure.

Specifically, the silane coupling agent useable for forming the inorganic material layer N may be 3-(trimethoxysilyl) propyl methacrylate (MAPTMS), acrylic acid 3-(trimethoxysilyl)propyl, vinyltriethoxysilane, vinyltrimethoxysilane, hexyl triethoxysilane, octyl triethoxysilane, decyl triethoxysilane, octadecyltriethoxysilane, 3-ureidopropyltriethoxysilane, aminopropyltriethoxysilane, triethoxy (3-(glycidyloxypropyl)silane, 3-isocyanatopropyltriethoxysilane, and the like, but is not limited thereto.

Such a silane coupling agent may be appropriately selected from organic materials forming the organic core particle A.

For example, when the organic material of the organic core particle A is an acrylic resin or a methacrylic resin, a silane coupling agent having a reactive bonding group (for example, alkoxy group such as a methoxy group) capable of interacting a functional group of the acrylic resin or the methacrylic resin may be selected.

When the organic material is a polyester resin, a silane coupling agent having a reactive bonding group (isocyanate group) capable of interacting a functional group of the polyester resin may be selected.

When the organic material is an epoxy resin, a silane coupling agent having a reactive bonding group (epoxy group) capable of interacting a functional group of the epoxy resin may be selected.

When the organic material is a urethane resin, a silane coupling agent having a reactive bonding group (isocyanate group) capable of interacting a functional group of the urethane resin may be selected.

The basic condition may have pH of greater than or equal to about 8 and less than or equal to about 13, for example greater than or equal to about 8 and less than or equal to about 10.

Basic materials providing the basic condition may be ammonia, sodium hydroxide, potassium hydroxide, and the like, but are not limited thereto.

In addition, in the process of forming a particle adhesion body of integrating an inorganic shell particle and an organic shell particle on the surface of an organic core particle, a particle adhesion body is formed by first adjusting pH of a dispersion liquid including the organic core particle and the inorganic shell particle into an isoelectric point (for example, pH 2.0) of a material for forming the inorganic shell particle to make the inorganic shell particle on the organic core particle present through a hetero agglomeration and by electrostatically adhering the inorganic shell particle on the surface of the organic core particle surface and then, by adding another dispersion liquid including an inorganic shell particle to the dispersion liquid to electrostatically adhere the organic shell particle on the surface of the organic core particle having the inorganic shell particle electrostatically adhered on the surface.

Then, the process of forming a complex particle is performed the same as the above process of forming a complex particle, obtaining a complex particle having the inorganic shell particle and the organic shell particle fixed on the surface of the organic core particle.

3. Particle Recovery Process

This particle recovery process may be performed to recover the complex particle as a dispersion liquid of the complex particle obtained from the above process of forming a complex particle.

In this process, the complex particle is separated and recovered as the dispersion liquid of the complex particle.

The recovery may be performed in any method, for example, a thermal concentration with an evaporator, a solid-liquid separation with a centrifugal sedimentation, and a lyophilization without a particular limit, unless it transforms the surface of the complex particle in the dispersion liquid and does damage on the complex particle.

The complex particle recovered through the recovery process may have all the properties illustrated in the above A and thus high adhesion strength of the inorganic shell particle B to the organic core particle A and secure a satisfactory charge amount and high flowability.

4. Particle Hydrophobizing Process

This particle hydrophobizing process makes a hydroxy group (an OH group) remaining on the surface of the complex particle with a hydrophobizing agent and thus introduce a hydrophobic group into the surface of the complex particle and thus hydrophobizes the surface of the complex particle.

In addition, this particle hydrophobizing process may be performed depending on a case of requiring high hydrophobicity and the like, for example, using the complex particle as an external additive for a toner and the like.

This particle hydrophobizing process hydrophobizes either the complex particle recovered through the above particle recovery process or the complex particle dispersed in a sol state.

As for the former process, the complex particle is formed through the process of forming a complex particle, the particle recovery process, and the particle hydrophobizing process in order.

For the latter process, the complex particle is formed through the process of forming a complex particle, the particle hydrophobizing process, and the particle recovery process in order.

The hydrophobizing agent may be a silazane compound such as hexamethyldisilazane (HMDS), 1,3-diphenyltetramethyldisilazane, 1,3-bis (3,3,3-trifluoro propyl)-1,1,3,3-tetramethyldisilazane, and 1,3-divinyl-1,1,3,3-tetramethyldisilazane, a silane compound such as methyl trimethoxysilane, dimethyldimethoxysilane, dimethyldiethoxysilane, isobutyl trimethoxysilane, octyl triethoxysilane, decyl triethoxysilane, trimethyl methoxysilane, and triethyl methoxysilane, but is not limited thereto.

A solvent for the silazane compound or the silane compound as this hydrophobizing agent may be a protic solvent such as water, ethanol, methanol, and the like or an aprotic solvent such as acetone, methylethylketone, methylisobutylketone, and the like.

The complex particle hydrophobized through the above particle hydrophobizing process on the surface has all the properties illustrated in the above A and hydrophobicity and thus may have high adhesion strength of the inorganic shell particle B to the organic core particle A and secures a satisfactory charge amount and high flowability and simultaneously maintain high hydrophobization.

C. External Additive For Toner

The external additive for a toner includes the complex particle explained in A.

Since the complex particle as the external additive for a toner has high adhesion strength of the inorganic shell particle B to the organic core particle A, and thus the inorganic shell particle B is difficult to be detached from the organic core particle A, an external additive for a toner including the complex particle is firmly adhered to a toner particle for a long term despite various stresses such as a shear force and the like.

In addition, the complex particle as the external additive for a toner may secure a satisfactory charge amount and high flowability.

Accordingly, a toner obtained by externally adding the complex particle as the external additive for a toner has high degradation resistance and maintains transfer efficiency over a long term and thus may be suppressed form coalescence on a visual receptor and from degradation of an image due to a member contamination and the like and provide stable image quality.

In addition, when the complex particle as the external additive for a toner has a relatively small average particle diameter in the average particle diameter range of the above Property (4), high flowability may be applied to the toner particle.

In addition, when the complex particle as the external additive for a toner has a relatively large average particle diameter in the average particle diameter range of the above Property (4), a spacer effect may be sufficiently realized.

In the complex particle according to Embodiment 1 including an organic core particle A and an inorganic shell particle B, a main component of the organic core particle A is an organic material, the inorganic shell particle B is present on the organic core particle A, a main component of the inorganic shell particle B is an inorganic material, an average particle diameter of the organic core particle A is greater than or equal to about 80 nm and less than or equal to about 300 nm and a coefficient of variation of an average particle diameter of the organic core particle A is greater than or equal to about 2% and less than or equal to about 10% and a ratio of the average particle diameter of the inorganic shell particle B relative to the average particle diameter of the organic core particle A is greater than or equal to about 0.016 and less than or equal to about 0.25, an average particle diameter of the complex particle is greater than or equal to about 90 nm and less than or equal to about 350 nm, a ratio $\beta_1/\beta_2$ of multipliers in a volume resistance $\rho_v=\alpha_1\times10^{\beta1}$ ($\Omega\cdot$cm) and a sheet resistance $\rho_s=\alpha_2\times10^{\beta2}$ ($\Omega/cm^2$) of the complex particle is greater than or equal to about 0.7 and less than or equal to about 1.4, and a change of the number of the inorganic shell particle B present on the organic core particle A before and after irradiating an ultrasonic wave to complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%.

The complex particle having the properties provides the following effects.

(i) The complex particle includes the inorganic shell particle B present on the surface of the organic core particle A and has a too low change of the inorganic shell particle B on the organic core particle A before and after irradiation of an ultrasonic wave under an predetermined condition, and thus high adhesion strength of the inorganic shell particle B on the organic core particle A compared with a conventional complex particle including the inorganic shell particle B that simply attached to the organic core particle A.

Because the adhesion strength of the inorganic shell particle B on the organic core particle A, the inorganic shell particle B is not detached from the organic core particle A even if the complex particle gets various stresses such as a shear force.

(ii) The complex particle has a volume resistance $\rho_v$ and a sheet resistance $\rho_s$ within the predetermined numeral ranges, and a satisfactory charge amount as initial characteristics may be ensured.

The satisfactory charge amount may be maintained for a long time because the adhesion strength of the inorganic shell particle B on the organic core particle A is high and the inorganic shell particle B is difficult to be detached from the organic core particle A.

(iii) Because the organic core particle A and the inorganic shell particle B have a ratio of an average particle diameter and an average particle diameter within predetermined numeral ranges, and simultaneously a coating ratio within a predetermined numeral range, when it is used as a component of an external additive for a toner, a toner and the complex particle always contact shell particles present on the toner and the complex particle, rollability is not deteriorated, and high flowability as initial characteristics may be ensured.

The complex particle having high flowability may be applied as a component of an external additive for a toner.

The high flowability may be maintained for a long time because the adhesion strength of the inorganic shell particle B on the organic core particle A is high and the inorganic shell particle B is difficult to be detached from the organic core particle A.

Accordingly, the complex particle according to the Embodiment 1 has high adhesion strength of the inorganic shell particle B on the organic core particle A, and ensures a satisfactory charge amount, and high flowability.

According to method of preparing the complex particle of Embodiment 1, a method of preparing the complex particle including the organic core particle A and the inorganic shell particle B includes organic material includes a process of forming a particle adhesion body wherein the inorganic shell particle B is adhered on the surface of the organic core particle A to provide a particle adhesion body, using dispersion liquid including the organic core particle A including an organic material as a main component and the inorganic shell particle B including an inorganic material as a main component, and a process of forming a complex particle wherein a silane coupling agent and a basic material that interact with reactive bonding group present on the surface of the organic core particle A and are (condensation) bound to a hydroxy group (OH group) of the surface of the inorganic shell particle B under a basic condition, are added to the dispersion liquid including the particle adhesion body and the inorganic shell particle B is fixed on the surface of the organic core particle A to provide the complex particle.

In the process of forming a particle adhesion body, a particle adhesion body is formed by making the inorganic shell particle B be present on the organic core particle A by hetero agglomeration, and electrostatically attaching the inorganic shell particle B to the surface of the organic core particle A, and in the process of forming a complex particle, the complex particle is formed by fixing the inorganic shell particle B on the surface of the organic core particle A by the inorganic material layer N formed by the silane coupling agent.

The complex particle may have all properties described above.

Accordingly, according to the method of preparing the complex particle of Embodiment 1, a complex particle having high adhesion strength of the inorganic shell particle B on the organic core particle A and ensuring a satisfactory charge amount, and high flowability.

The external additive for a toner of the Embodiment 1 may include the above complex particle.

Accordingly, this external additive for a toner secures high adhesion strength of the inorganic shell particle B on the surface of the organic core particle A, a satisfactory charge amount, and high flowability and thus may have higher degradation resistance than a conventional one, maintain adhesion of the external additive for a toner with a toner particle for a long term and high transfer efficiency and suppress an image defect due to a member contamination and simultaneously, provide stable image quality, since the external additive for a toner is hardly detached from the toner particle.

Embodiment 2

A. Complex Particle

The complex particle includes a core particle including an inorganic material as a main component (hereinafter, the core particle is referred to as an inorganic core particle), and a shell particle present on the inorganic core particle and including an organic material as a main component (hereinafter, the shell particle is referred to as an organic shell particle), unlike the complex particle according to Embodiment 1.

The complex particle has the following Properties (1) to (6) like Embodiment 1.

Property (1): An average particle diameter of the inorganic core particle is greater than or equal to about 80 nm and less than or equal to about 300 nm.

Property 2: A coefficient of variation of an average particle diameter of the inorganic core particle is greater than or equal to about 2% and less than or equal to about 10%.

Property 3: an average particle diameter of the organic shell particle is greater than or equal to about 5 nm and less than or equal to about 30 nm, and simultaneously a ratio of the average particle diameter of the organic shell particle relative to the average particle diameter of the inorganic core particle (hereinafter, referred to as "an average particle diameter of the organic shell particle/an average particle diameter of the inorganic core particle") is greater than or equal to about 0.016 and less than or equal to about 0.25.

Property (4): An average particle diameter of the complex particle is greater than or equal to about 90 nm and less than or equal to about 350 nm.

Property (5): A ratio $\beta_1/\beta_2$ of multipliers in a volume resistance $\rho_v$ and sheet resistance $\rho_s$ of the complex particle is greater than or equal to about 0.7 and less than or equal to about 1.4.

Property (6): A change of the number of the organic shell particle present on the inorganic core particle before and after irradiating an ultrasonic wave to complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%.

The core particle and the shell particle comprising this complex particle have the following points in common and difference with the core particle and the shell particle constituting the complex particle according to the Embodiment 1.

<Inorganic Core Particle>

The inorganic core particle commonly includes an inorganic material as a main component like the inorganic shell particle B described in A of the Embodiment 1.

However, the inorganic core particle having an average particle diameter satisfying Properties (1) to (3) as a core particle is different from the inorganic shell particle B having an average particle diameter satisfying only the Property (3) according to the Embodiment 1.

<Organic Shell Particle>

The organic shell particle has a common with the organic core particle A of the Embodiment 1, in that it has an organic material such as the organic material described in A of the Embodiment 1 as a main component.

However, the organic shell particle having an average particle diameter satisfying only the Property (3) as a shell particle is different from the organic core particle A having an average particle diameter satisfying Properties (1) to (3) according to the Embodiment 1.

In addition, the complex particle has volume resistance $\rho_v$ depending on resistance of an inorganic material forming the inorganic core particle and an organic material forming the shell particle B and sheet resistance $\rho_s$ depending on surface electrical resistance on the surface of the complex particle.

Since the inorganic material forming the inorganic core particle has lower electric resistance than the organic material forming the organic shell particle, the complex particle having the above structure has low volume resistance $\rho_v$ but increased sheet resistance $\rho_s$.

In general, a charge charged on the surface of a particle enters the particle or moves from the surface of the particle (for example, the contact surface of a toner particle with an externally-added complex particle) along the surface of the particle to another particle.

However, in the complex particle including the inorganic core particle and the organic shell particle, a charge charged on the surface limitedly moves toward another particle (for example, a toner particle) and is slowly accumulated inside the complex particle particularly under low humidity.

Accordingly, the volume resistance $\rho_v$ and the sheet resistance $\rho_s$ may have relationship satisfying Property (5) within an appropriate numeral range.

The complex particle having all the Properties (1) to (6) may have relative permittivity of greater than or equal to about 2 and less than or equal to about 300 and satisfies Property (7) like the complex particle of the embodiment.

The complex particle having all the above Properties (1) to (6) or the complex particle having Property (7) as well as all the above Properties (1) to (6) may have a coating ratio of greater than or equal to about 5% and less than or equal to about 68% of the organic shell particle on the surface of the inorganic core particle and satisfies Property (8) like the complex particle of the Embodiment 1.

The complex particle having all the Properties (1) to (6), or the complex particle having the Property (7) or the Property (8) in addition to the Properties (1) to (6) may further include an inorganic material layer N coating the surface of the inorganic core particle and the surface of the organic shell particle like the complex particle according to Embodiment 1.

The inorganic material layer N is formed by a silane coupling agent interacting the organic shell particle and also, combined (condensed) with a hydroxy group (an OH group) on the surface of the inorganic core particle under a basic condition.

The silane coupling agent itself and the hydroxy group (OH group) on the surface of the inorganic core particle form a network structure under the basic condition and thus the inorganic material layer N having a similar structure to the amorphous structure of silica internally having silicon (Si).

In this way, the inorganic material layer N has a network structure coating the surface of the inorganic core particle and the surface of the organic shell particle and thus plays a role of increasing silicon (Si) of the organic shell particle to the inorganic core particle and also, has a similar structure to the amorphous structure of silica including silicon (Si) and thus shows equivalent electrical resistance to a film formed of an inorganic material such as silica and thus plays a role of adjusting a balance between volume resistance $\rho_v$ and sheet resistance $\rho_s$ of the complex particle.

The complex particle having the above properties according to the Embodiment 2 is obtained by making a negatively charged organic shell particle present on the positively charged inorganic core particle through a hetero agglomeration and electrostatically adhering both of the particles by coating the inorganic material layer N formed by the above silane coupling agent on the surface of a particle adhesion body obtained by coupling and integrating the organic shell particle on the surface of the inorganic core particle on the surface of the inorganic core particle and the surface of the organic shell particle and fixing the organic shell particle on the surface of the inorganic core particle.

Examples corresponding to such a complex particle are Examples 2-1 to 2-8, which will be described later.

In addition, when being combined in this way, a positively charged inorganic shell particle is present on the surface of a negatively charged complex particle through a hetero agglomeration, and is electrostatically adhered thereon.

In addition, a complex particle having an organic shell particle and an inorganic shell particle fixed on the surface of an inorganic core particle is obtained by forming an inorganic material layer N formed through the above silane coupling agent on the surface of a particle adhesion body obtained by coupling and integrating the organic shell particle and the inorganic shell particle on the surface of the inorganic core particle to coat each surface of the inorganic core particle, the organic shell particle, and the inorganic shell particle, forming.

In other words, this complex particle is obtained by integrating the inorganic core particle with the organic shell particle and the inorganic shell particle fixed on the surface of the inorganic core particle.

Examples corresponding to such a complex particle are Examples 4-1 to 4-6, which will be described later.

B. Method of Preparing Complex Particle

The method of preparing the complex particle including the inorganic core particle and the organic shell particle includes a process of forming a particle adhesion body wherein forming a particle adhesion body including the organic shell particle adhered on the surface of the inorganic core particle using dispersion liquid including an inorganic core particle including an inorganic material as a main component and an organic shell particle including an organic material as a main component, and a process of forming a complex particle wherein a silane coupling agent and a basic material that interact with a reactive bonding group present on the surface of the organic shell particle and are (condensation) bound to a hydroxy group (OH group) of the surface of the inorganic core particle under a basic condition, are added to the dispersion liquid including the particle adhesion body, and an organic shell particle is fixed on the surface of the inorganic core particle to provide a complex particle.

In the process of forming a particle adhesion body, a particle adhesion body is formed by making the organic shell particle be resent on the inorganic core particle by hetero agglomeration, and electrostatically attaching the organic shell particle to the surface of the inorganic core particle, and in the process of forming a complex particle, the complex particle is formed by fixing the organic shell particle on the surface of the inorganic core particle by the inorganic material layer N formed by the silane coupling agent.

The preparing method is one of methods of preparing complex particles having properties explained in the above A.

The process of forming a particle adhesion body, its preparation, and the process of forming a complex particle may be performed the same as the process of forming a particle adhesion body, its preparation, and the process of forming a complex particle for preparing the complex particle according to the Embodiment 1 except for using an inorganic core particle instead of the organic core particle A and organic shell particles instead of the inorganic shell particles B.

In addition, in the process of forming a particle adhesion body of integrating an inorganic core particle and an organic shell particle on the surface of the inorganic core particle, a particle adhesion body is formed by first adjusting pH of a dispersion liquid including the inorganic core particle and the organic shell particle into an isolelectric point (for example, pH 2.0) of a material for forming the inorganic core particle to make the organic shell particle be present on the inorganic core particle through a hetero agglomeration and electrostatically adhere the organic shell particle on the surface of the inorganic core particle, and by adding another dispersion liquid including an inorganic shell particle to the dispersion liquid to electrostatically adhere again the inorganic shell particle on the surface of the inorganic core particle having the organic shell particle electrostatically adhered on the surface.

Then, in the process of forming a complex particle, a complex particle having the organic shell particle and the inorganic shell particle fixed on the surface of the inorganic core particle is obtained according to the same process of forming a complex particle of preparing the complex particle according to the Embodiment 1 except for using an inorganic core particle instead of the organic core particle A and an organic shell particle instead of the inorganic shell particle B.

C. External Additive for Toner

The external additive for a toner includes the complex particle explained in the above A.

Since a complex particle as the external additive for a toner has high adhesion strength of organic shell particles to an inorganic core particle, and the organic shell particles are hardly detached from the inorganic core particle, the external additive for a toner of the complex particle is firmly adhered to a toner particle for a long term despite various stresses such as a shear force and the like applied thereto.

In addition, the complex particle as the external additive for a toner may secure a satisfactory charge amount and high flowability.

Accordingly, a toner obtained by externally adhering the complex particle as the external additive for a toner has high degradation resistance and maintains high transfer efficiency over a long term and thus may suppress image degradation due to a member contamination such as coalescence of a toner on a visual receptor and the like and provide stable image quality.

In addition, when the complex particle as the external additive for a toner has a relatively small average particle diameter within the average particle diameter range of the above Property (4), high flowability may be applied to the toner particle.

Furthermore, when the complex particle as the external additive for a toner has a relatively large average particle diameter in the average particle diameter range of the above Property (4), a spacer effect will be sufficiently realized.

In the complex particle according to Embodiment 2 including an inorganic core particle and an organic shell particle, an inorganic main component of the core particle is an inorganic material, the organic shell particle is present on the inorganic core particle, a main component of the organic shell particle is an organic material, an average particle diameter of the inorganic core particle is greater than or equal to about 80 nm and less than or equal to about 300 nm and a coefficient of variation of an average particle diameter of the inorganic core particle is greater than or equal to about 2% and less than or equal to about 10%, an average particle diameter of the organic shell particle is greater than or equal to about 5 nm and less than or equal to about 30 nm, simultaneously a ratio of the average particle diameter of the organic shell particle relative to the average particle diameter of the inorganic core particle is greater than or equal to about 0.016 and less than or equal to about 0.25, an average particle diameter of the complex particle is greater than or equal to about 90 nm and less than or equal to about 350 nm, a ratio $\rho_r$ of a volume resistance $\rho_v$ of the complex particle and a sheet resistance $\rho_s$ is greater than or equal to about 0.7 and less than or equal to about 1.4, and a change of the number of the organic shell particle present on the inorganic core particle before and after irradiating an ultrasonic wave to complex particle dispersion liquid including about 1 wt % of the complex particle dispersed in water, under a condition of a power of about 110W and a frequency of about 31 kHz for about 30 minutes, is greater than or equal to about 0.5% and less than or equal to about 5%.

The complex particle having the properties provides the following effects.

(i) The complex particle includes the organic shell particle fixed on the surface of the inorganic core particle and has a too low change of the organic shell particle on the inorganic core particle before and after irradiation of an ultrasonic wave under an predetermined condition, and thus high adhesion strength of the organic shell particle on the inorganic core particle compared with a conventional complex particle including the organic shell particle that simply attached to the inorganic core particle.

Because the adhesion strength of the organic shell particle on the inorganic core particle, the organic shell particle is not detached from the inorganic core particle even if the complex particle gets various stresses such as a shear force.

(ii) The complex particle has a volume resistance $\rho_v$ and a sheet resistance $\rho_s$ within the predetermined numeral ranges, and a satisfactory charge amount as initial characteristics may be ensured.

The satisfactory charge amount may be maintained for a long time because the adhesion strength of the organic shell particle on the inorganic core particle is high and the organic shell particle is difficult to be detached from the inorganic core particle.

(iii) Because the inorganic core particle and the organic shell particle have a ratio of an average particle diameter and an average particle diameter within predetermined numeral ranges, and simultaneously a coating ratio within a predetermined numeral range, when it is used as a component of an external additive for a toner, a toner and the complex particle always contact shell particles present on the toner and the complex particle, rollability is not deteriorated, and high flowability as initial characteristics may be ensured.

The complex particle having high flowability may be applied as a component of an external additive for a toner.

The high flowability may be maintained for a long time because the adhesion strength of the organic shell particle on the inorganic core particle is high and the organic shell particle is difficult to be detached from the inorganic core particle.

Accordingly, the complex particle according to the Embodiment 2 has high adhesion strength of the organic shell particle on the inorganic core particle, and ensures a satisfactory charge amount, and high flowability.

According to method of preparing the complex particle of Embodiment 2, a method of preparing the complex particle including the inorganic core particle and the organic shell particle includes a process of forming a particle adhesion body wherein forming a particle adhesion body including the organic shell particle adhered on the surface of the inorganic core particle using dispersion liquid including an inorganic core particle including an inorganic material as a main component and an organic shell particle including an organic material as a main component, and a process of forming a complex particle wherein a silane coupling agent and a basic material that interact with a reactive bonding group present on the surface of the organic shell particle and are (condensation) bound to a hydroxy group (OH group) of the surface of the inorganic core particle under a basic condition, are added to the dispersion liquid including the particle adhesion body, and an organic shell particle is fixed on the surface of the inorganic core particle to provide a complex particle.

In the process of forming a particle adhesion body, a particle adhesion body including organic shell particles present on the inorganic core particle by hetero agglomeration, and electrostatically attached to the surface of the inorganic core particle, and in the process of forming a complex particle, the complex particle is formed by fixing organic shell particle on the surface of the inorganic core particle by the inorganic material layer N formed by the silane coupling agent.

The complex particle may have all properties explained above.

Accordingly, a method of preparing the complex particle of the Embodiment 2 may provide a complex particle having high adhesion strength of organic shell particles to an inorganic core particle and securing a satisfactory charge amount and high flowability.

An external additive for a toner according to the Embodiment 2 includes the above complex particle.

Accordingly, this external additive for a toner may have high adhesion strength of organic shell particles to an inorganic core particle and secure a satisfactory charge amount and high flowability and thus have a higher degradation resistance than a conventional one and also, maintain adhesion with a toner particle for a long term and be hardly detached from the toner particle and simultaneously, maintain transfer efficiency in a high state and resultantly, suppress an image defect from a member contamination and provide stable image quality.

EXAMPLES

The disclosed examples shall not be interpreted as limiting this disclosure.

The following Examples are limited by a case of using a complex particle according to the present invention as an external additive for a toner.

Before illustrating Examples and Comparative Examples, each measurement method and evaluation test in Examples and Comparative Examples are first illustrated.

Method of Obtaining Average Particle Diameter

The average particle diameter of complex particles and also, the average particle diameters of core particles and shell particles before combination are obtained by examining SEM images.

1. Average Particle Diameter of Complex Particles

In the SEM image examination, each SEM image for 100 complex particles in total is binarized to obtain each binarized image of the complex particles while changing a view of the SEM image.

Based on the binarized image, after obtaining an imaginary maximum inscribed circle (marked by an internal dotted line in FIG. 3) from the circular outline of the cross section of the complex particle shown in FIG. 3, the average particle diameter of the complex particle is obtained by using the diameter D of the farthest circle (marked by the outmost dotted line in FIG. 3) from the imaginary maximum inscribed circle.

2. Average Particle Diameter of Core Particles and Shell Particles Before Combination As described above, each 100 core particle or shell particle in total is taken of a SEM image, the SEM image is binarized by changing its view to obtain each binarized image of the core particle or the shell particle.

As shown in FIG. 4 based on the binarized image, the diameter DA of the core particle or the diameter DB of the shell particle is obtained by calculating twice of a distance between an intersection point of two perpendicular lines with any two chords (chords X and Y shown in FIG. 4) and the farthest point from the intersection point on substantially circular part corresponding to the surface of a particle.

Volume Resistance and Sheet Resistance Evaluations of Complex Particle

The volume resistance and sheet resistance of complex particles are obtained in the following method.

1. Measurement of Volume Resistance

First of all, 10 g of a complex particle and 3.3 g of a thermal-curing epoxy resin (Product Name: SPECIFIX-20, Manufacturer: Struers) are added to 10 g of methanol, the complex particle is dispersed in the thermal-curing epoxy resin and kneaded therewith, and the kneaded product is crushed with a mortar and a pestle for one hour.

The obtained gel-type material flows in a mold and is pressed with 20 MPa of a pressure by using a hydraulic presser, and the molded product is dried at 80° C. for 12 hours, obtaining a pellet formed of a composite material of the complex particle and the epoxy resin.

Then, an electrode is mounted on both sides of the pellet by using a silver (Ag) paste, and a circuit for measuring volume resistance as shown in FIG. 5 is built to measure volume resistance.

The same measurement of another pellet obtained by changing a ratio of a complex particle and an epoxy resin is performed, a calibration curve based on a volume resistance change according to the ratio of the epoxy resin, an intercept of a coordinate axis with the calibration curve (volume resistance when the ratio of the epoxy resin is 0%) is calculated as volume resistance (Ω·cm) of the complex particle.

2. Measurement of Sheet Resistance

The sheet resistance ($\Omega/cm^2$) of the complex particle is measured in the same method as above by building a circuit for measuring sheet resistance shown in FIG. 6 with the same pellet as above.

Measurement of Relative Permittivity of Complex Particle

The relative permittivity of the complex particle is obtained in the following method.

A dielectric constant is measured with the dielectric constant measuring device by changing a ratio between the complex particle and an epoxy resin in the above pellet, a calibration curve based on a dielectric constant change according to the ratio of the epoxy resin is obtained, and an intercept (a dielectric constant when the epoxy resin ratio is 0%) of a coordinate axis with the calibration curve is obtained as the dielectric constant ε (F/m) of the complex particle.

Then, a ratio (relative permittivity of the complex particle: $\varepsilon_r=\varepsilon/\varepsilon_0$) of the dielectric constant ε of the complex particle relative to the dielectric constant $\varepsilon_0$ of vacuum (about $8.854\times10^{-12}$ F/m) is calculated.

Charge Amount Evaluation of Complex Particle 30 parts by weight of a ferrite particle (volume average particle diameter: 35 μm) coated with a styrene/methyl methacrylate resin is put in a glass jar with a cap, and 1 part by weight of the complex particle is put therein with the ferrite particle therein.

Then, the glass jar is allowed to stand at room temperature under normal humidity (25° C./50% RH) and seasoned for 24 hours and then, stirred with a tubular mixer for 3 minutes to apply a load to the complex particle, generating generate a friction charge by colliding the complex particle with the ferrite particle.

The charge amount (μC/g) of the complex particle is measured by using an electric field ratio equation-based charge amount measurement device (Product name: II-DC electric field, Manufacturer: DIT Co., Ltd.).

In addition, the volume average particle diameter of the ferrite particle is measured by using a particle distribution measuring device (Registered trademark: Multisizer, Manufacturer: Beckman-Coulter, Inc.).

Adhesion Strength Evaluation of Shell Particle on Core Particle in Complex Particle First, 100 complex particles in a dry state are examined through a SEM image to count shell particles on the surface of a core particle (the number of shell particles before radiating an ultrasonic wave).

On the other hand, complex particle dispersion liquid is prepared by dispersing the same complex particle as above in a ratio of 1 wt % in water.

The complex particle dispersion liquid is radiated by an ultrasonic wave for 30 minutes under a condition of a power of 110 W and a frequency of 31 kHz.

Subsequently, the complex particle dispersion liquid is centrifugally sedimented to separate solid-liquid, and a sediment is separately collected and then, dried through lyophilization.

Among the dried solids, 100 complex particles are examined through a SEM image to count shell particles on the core particle (the number of shell particles after radiating the ultrasonic wave).

The numbers of the shell particles before and after radiating the ultrasonic wave are used to obtain a change (%) of the shell particles before and after radiating the ultrasonic wave.

A: the number of shell particles has a change ranging from greater than or equal to 0.5% and less than 3%, the shell particles are adhered with very high strength on a core particle and fixed thereon through very high adhesion strength (appropriately usable).

B: the number of shell particles has a change ranging from greater than or equal to 3% and less than 5%, the shell particles are adhered with high strength on a core particle and fixed thereon through high adhesion strength (sufficiently usable).

C: the number of shell particles has a change ranging from greater than or equal to 5% and less than 10%, the shell particles are adhered with low strength on a core particle and fixed thereon through low adhesion strength (controversial about judgment of usage).

D: the number of shell particles has a change ranging from greater than or equal to 10%, the shell particles are adhered with very low strength on a core particle and fixed thereon through very low adhesion strength (not usable regardless of usage).

Flowability Evaluation of Complex Particle

Two parts by weight of the complex particle are added to 100 parts by weight of an acryl particle (MX-1000, Soken Chemical & Engineering Co., Ltd.), and the mixture is mixed with a sample mill at 10,000 rpm for 30 seconds, obtaining 102 parts by weight of a particle mixture.

Then, 2.0 parts by weight of the complex particle for evaluation out of 102 parts by weight of the particle mixture is put in a glass jar with a cap and allowed to stand at room temperature/normal humidity (23° C./50% of RH) and seasoned for 24 hours, and then, the initial agglomeration degree is measured by using a powder tester including a 3 layered sieve (Hosokawa Micron Corp.).

In addition, 1 part by weight of the particle separated from 100 parts by weight of the rest of the particle mixture and 30 parts by weight of a ferrite particle coated with a styrene/methyl methacrylate resin (a volume average particle diameter: 35 μm) are put in a glass jar with a cap and stirred at room temperature under normal humidity (23° C., 50% of RH) with tubular mixer for 1 hour to test durability of the above complex particle.

Subsequently, the complex particle remaining after remaining the ferrite particle by using a magnet is measured regarding an agglomeration degree after the durability test initial agglomeration with the powder tester, and then, its agglomeration change relative to the initial agglomeration is obtained.

This durability test is to apply a stress to the complex particle by colliding it with the ferrite particle having a larger specific gravity than the complex particle.

When the complex particle has the stress and thus does not maintain a spherical shape or is attached to the ferrite resin, the complex particle may lose flowability and be more agglomerated.

In addition, the volume average particle diameter of the ferrite particle is measured by using a particle distribution measuring device (Registered trademark: Multisizer, Manufacturer: Beckman-Coulter, Inc.).

A: an agglomeration degree change is less than 10%, and very high flowability after a durability test is secured (appropriately usable).

B: an agglomeration degree change is greater than or equal to 10% and less than 20%, and high flowability after a durability test is secured (sufficiently usable).

C: an agglomeration degree change is greater than or equal to 20% and less than 30%, and a considerable amount of particle losing flowability after a durability test is present (controversial about judgment of usage).

D: an agglomeration degree change is greater than or equal to 30%, and a large amount of particle losing flowability after a durability test is present (not usable regardless of usage).

Hereinafter, a method of forming an organic particle and an inorganic particle is further illustrated.

The organic particle is formed according to Synthesis Examples 1 to 6, and herein, a part of a complex particle is comprised by using either one of a core particle or a shell particle.

The inorganic particle is formed according to Synthesis Examples 7 to 12, and herein, a part of a complex particle is comprised by using either one of a shell particle or a core particle.

Synthesis Example 1

Synthesis of Organic Particle 2400 g of water is put in a 3 L reaction vessel including a condenser, a thermometer, and a nitrogen inlet, and then, oxygen in the reaction vessel is removed by introducing nitrogen gas into the reaction vessel for 1 hour. Subsequently, 150 g of methyl methacylate (MMA) (Tokyo Chemical Industry Co., Ltd.), 5 g of sodium p-styrene sulfonate (NaSS) as a particle diameter-controlling agent, and 30 g of 3-(trimethoxysilyl)propyl methacrylate (MAPTMS) are added thereto, 5 g of potassium persulfate (KPS) as a reaction initiator is added thereto, the mixture is reacted at 80° C. for 6 hours, obtaining a polymethyl methacylate (PMMA) particle cross-linked by MAPTMS as the organic particle. The PMMA particle is solid-liquid separated through centrifugal sedimentation, a supernatant is removed therefrom through decantation, 500 g of distilled water is added thereto, and the mixture is agitated for one hour, obtaining dispersion liquid. Subsequently, a series of operation of adding 500 g of distilled water, separating solid-liquid through centrifugal sedimentation, and decantation of a supernatant is three times in total repeated, and 820 g of water is finally added thereto, obtaining PMMA particle aqueous dispersion liquid. The obtained PMMA particle has an average particle diameter of 80 nm when examined through an SEM image, and the average particle diameter has a coefficient of variation of 5%. Table 1 shows each mixing amount of the aforementioned MMA, NaSS, MAPTMS, KPS, and water of Synthesis Example 1.

Synthesis Examples 2 to 5

A PMMA particle (average particle diameter examined by a SEM image: 8 nm to 300 nm, coefficient of variation of the core average particle diameter: 2% to 10%) as the organic particle is synthesized according to the same method as Synthesis Example 1 except for changing each mixing amount of the aforementioned MMA, NaSS, MAPTMS, KPS, and water as shown in Table 1.

TABLE 1

| | | Synthesis Example 1 | Synthesis Example 2 | Synthesis Example 3 | Synthesis Example 4 | Synthesis Example 5 |
|---|---|---|---|---|---|---|
| Organic particle | Water (g) | 2400 | 2400 | 2400 | 2400 | 2400 |
| | Methyl methacrylate (MMA) (g) | 150 | 300 | 300 | 50 | 20 |
| | Sodium p-styrene sulfonate (NaSS) (g) | 5 | 5 | 3 | 5 | 5 |
| | 3-(trimethoxysilyl)propyl methacrylate (MAPTMS) (g) | 30 | 60 | 60 | 5 | 3 |
| | Potassium persulfate (KPS) (g) | 5 | 5 | 5 | 5 | 3 |
| | Average particle diameter of organic particle (nm) | 80 nm | 205 nm | 300 nm | 30 nm | 8 nm |
| | Coefficient of variation (Cv) of average particle diameter of organic particle (%) | 5% | 3% | 2% | 9% | 10% |

Synthesis Example 6

Synthesis of Silica Particle 1250 g of ethanol, 1250 g of acetonitrile, and 178 g of tetraethoxysilane are put in a 5 L reaction vessel including a condenser, a thermometer, and a nitrogen inlet, controlled at 50° C., and then, stirred at 150 rpm, and a mixture of 600 g of distilled water and 40 g of a 10% ammonia solution is heated up to 50° C. and immediately added thereto at one time.

Subsequently, the mixture is stirred at 50° C. for 10 hours, 1000 g of distilled water is added thereto, and the resulting mixture is concentrated with an evaporator until its amount becomes a half and solid-liquid separated through centrifugal sedimentation.

After removing a supernatant therefrom through decantation, 800 g of distilled water is added thereto, and the mixture is stirred for 1 hour and separated between solid-liquid.

Subsequently, a series of operation of adding 800 g of distilled water, separating solid-liquid through a centrifugal sedimentation, and decantating a supernatant therefrom is three times in total repeated, 200 g of water is finally added thereto, obtaining a white dispersion liquid in which a silica particle (Average particle diameter through examination of a SEM image: 20 nm, Coefficient of variation of the average particle diameter: 10%) is dispersed.

Each mixing amount of the above ethanol, acetonitrile, tetraethoxysilane, water, and 10% ammonia according to Synthesis Example 6 is shown in Table 2.

Synthesis Examples 6 to 11

A silica particle (Average particle diameter through examination of a SEM image: 9 to 290 nm, a coefficient of variation of the average particle diameter of a core particle: 2% to 10%) as the inorganic particle is synthesized according to the same method as Synthesis Example 7 except for changing the mixing amount of the above tetraethoxysilane, water, and 10% ammonia as shown in Table 2.

Synthesis Example 12

Synthesis of Strontium Titanate

A reaction vessel is prepared in a glove box, and 18 g of metal strontium (Nacalai Tesque, Inc.) is dissolved in 1100 g of 2-methoxy ethanol (Wako Pure Chemical Industries, Ltd.).

After completely dissolving the metal strontium, 48 g of titanium tetraethoxide (Dong Kyung Co., Ltd.) is added thereto, and reaction vessel is covered and taken from the glove box.

Subsequently, a condenser, a thermometer, and a nitrogen inlet are equipped in the reaction vessel, and the reaction vessel is refluxed under a nitrogen atmosphere for 2 hours, obtaining strontium titanate dispersion liquid.

Then, 1000 g of distilled water is added thereto, and the mixture is concentrated by using an evaporator until its amount becomes a half and then, solid-liquid separated through a centrifugal sedimentation.

After removing a supernatant therefrom through decantation, 800 g of distilled water is added thereto, and the resulting mixture is stirred for one hour and also, solid-liquid separated in the same method.

Subsequently, a series of operation of adding 800 g of distilled water, separating solid-liquid through a centrifugal sedimentation, and decantating a supernatant therefrom is three times in total repeated, 200 g of water is finally added thereto, obtaining a white dispersion liquid in which a silica particle having an average particle diameter of 18 nm is dispersed.

Table 2 shows the mixing amount of the above strontium, 2-methoxy ethanol, and titanium tetraethoxide of Synthesis Example 13.

TABLE 2

| | | Synthesis Example 6 | Synthesis Example 7 | Synthesis Example 8 | Synthesis Example 9 | Synthesis Example 10 | Synthesis Example 11 | Synthesis Example 12 |
|---|---|---|---|---|---|---|---|---|
| Inorganic particle | Ethanol (g) | 1250 | 1250 | 1250 | 1250 | 1250 | 1250 | |
| | Acetonitrile (g) | 1250 | 1250 | 1250 | 1250 | 1250 | 1250 | |
| | 2-methoxyethanol (g) | | | | | | | 1100 |
| | Tetraethoxy silane (g) | 178 | 178 | 178 | 324 | 250 | 600 | |
| | Strontium (g) | | | | | | | 18 |
| | Titanium tetraethoxide (g) | | | | | | | 48 |
| | Water (g) | 600 | 100 | 500 | 1000 | 1000 | 1000 | |

TABLE 2-continued

| | Synthesis Example 6 | Synthesis Example 7 | Synthesis Example 8 | Synthesis Example 9 | Synthesis Example 10 | Synthesis Example 11 | Synthesis Example 12 |
|---|---|---|---|---|---|---|---|
| 10% ammonia (g) | 40 | 40 | 20 | 50 | 40 | 100 | |
| inorganic particle average particle diameter (nm) | 20 nm | 30 nm | 9 nm | 110 nm | 80 nm | 290 nm | 18 nm |
| Coefficient of variation (Cv) of average particle diameter of inorganic particle (%) | 10% | 7% | 10% | 3% | 7% | 2% | 10% |

Examples 1-1 to 1-14

Examples 1-1 to 1-14 are Preparation Examples providing complex particles including one kind of organic core particle and one kind of inorganic shell particle.

Example 1-1

Preparation of Complex Particle

1. Process of Forming Particle Adhesion Body 555 g of an organic particle dispersion liquid including 100 g of the PMMA particle (Average particle diameter: 80 nm) synthesized according to Synthesis Example 1 at a liquid temperature of 30° C. and 1565 g of an inorganic shell particle dispersion liquid including 313 g of the silica shell particle (Average particle diameter: 20 nm) synthesized according to Synthesis Example 6 at a liquid temperature of 30° C. are mixed in a reaction vessel including a condenser, a thermometer, and a nitrogen inlet, obtaining a dispersion liquid.

Subsequently, distilled water is added thereto until the amount of the dispersion liquid is reduced down to 2500 g.

Then, the dispersion liquid is stirred for 3 hours at 30° C.

Subsequently, a 0.1 M hydrochloric acid solution is added thereto over 2 hours until the dispersion liquid has pH 2.0 while the dispersion liquid is stirred at the same liquid temperature and stopped when the pH becomes 2.0.

Then, the resultant is heated up to 60° C. and stirred at 60° C. for 5 hours, forming a particle adhesion body in which the silica shell particle is attached to the PMMA particle.

2. Process of Forming Complex Particle

After cooling the dispersion liquid in which the particle adhesion body is formed down to room temperature, 50.0 g of MAPTMS is added to the dispersion liquid at one time, and a 10% ammonia solution is slowly added thereto over 2 hours until the mixture has pH 8.0 while the mixture is stirred.

When the dispersion liquid has pH 8.0, the resultant is heated up to 50° C. while the pH is maintained and then, reacted for 6 hours up to 50° C., obtaining a complex particle having the silica shell particle on the surface of the PMMA particle.

Subsequently, a centrifugal sedimentation is performed to separate solid-liquid, a supernatant is removed therefrom through decantation, 500 g of distilled water is added thereto, and the mixture is stirred for one hour, obtaining dispersion liquid.

Then, a series of operation of adding 500 g of distilled water, separating solid-liquid through a centrifugal sedimentation, and decantating a supernatant therefrom is three times in total repeated, a solid-liquid is finally separated through a centrifugal sedimentation again, and a precipitate is lyophilized for 24 hours, obtaining a white powder.

3. Particle Hydrophobizing Process 10 g of the white powder obtained through the process of forming a complex particle is added to a mixture of 200 g of water, and 15 g of hexamethyldisilazane (HMDS), the resulting mixture is stirred at room temperature for 30 minutes and also, at 60° C. for 4 hours, and a precipitate obtained through a solid-liquid separation therefrom is cleaned with methanol and dried at 50° C. for 48 hours, obtaining a white powder of the complex particle having a hydropobized surface (Average particle diameter obtained through examination of a SEM image: 122 nm).

Each amount of an organic particle, an inorganic particle, water, MAPTMS and HMDS in Example 1-1 is shown in Table 3.

Confirmation of Properties of Complex Particle of Example 1-1

Tables 1, 2, and 3 show that the average particle diameter of a core particle of the complex particle according to Example 1-1, a coefficient of variation of the average particle diameter, the average particle diameter of a shell particle/the average particle diameter of a core particle, a resistance ratio $\rho_r$, the average particle diameter of the complex particle, relative permittivity, and a coating ratio.

In addition, the complex particle has a number change of less than 3% as shown in the adhesion strength evaluation of the shell particle relative to the core particle.

Accordingly, the complex particle of Example 1-1 has the above Properties (1) to (8).

Evaluation of Complex Particle of Example 1-1

The complex particle of Example 1-1 has flowability of [A] according to adhesion strength and agglomeration degree change of a shell particle relative to a core particle.

In addition, the complex particle of Example 1-1 has a satisfactory charge amount.

Examples 1-2 to 1-11

Preparation of Complex Particles of Examples 1-2 to 1-11

A complex particle prepared according to the same method as complex particle is used except for changing each mixing amount of organic particle as the complex particles of Examples 1-2 to 1-11, a silica particle, and water as shown in Table 3.

Example 1-12

Preparation of Complex Particle of Example 1-12

Example 1-12 uses a complex particle prepared according to the same method as Example 1-1 except for using strontium titanate synthesizing according to Synthesis Example 12 instead of the silica particle.

Example 1-13

Preparation of Complex Particle of Example 1-13

A complex particle of Example 1-13 is prepared according to the same method as Example 1-1 except for using titanium oxide SRD-02W (SAKAI CHEMICAL INDUSTRY Co., Ltd.) having an average particle diameter of 9 nm instead of the silica particle.

Example 1-14

Preparation of Complex Particle of Example 1-14

A complex particle of Example 1-14 is prepared according to the same method as Example 1-1 except for using cerium oxide, TECNADIS-CE-115 (TECNAN) having an average particle diameter of 5 nm instead of the silica particle. Each amount of the organic particle according to Examples 1-2 to 1-14, an inorganic particle, water, MAPTMS, and HMDS are shown in Table 3.

Confirmation of Properties of Complex Particles of Examples 1-2 to 1-14

The average particle diameter of the core particle, a coefficient of variation of the average particle diameter, the average particle diameter of a shell particle/the average particle diameter of the core particle, a resistance ratio $\rho_r$, the average particle diameter of the complex particle, relative permittivity, and a coating ratio of each complex particle according to Examples 1-2 to 1-14 are shown in Tables 1, 2 and 3.

Each complex particle of Examples 1-2, 1-3, 1-5, 1-6, 1-8, 1-9, 1-11 to 1-14 shows a number change of less than 3% as shown in the adhesion strength of a shell particle to a core particle, and specifically, the complex particles of Examples 1-4, 1-7, and 1-10 show a number change of greater than or equal to 3% and less than 5% as shown in the adhesion strength of a shell particle to a core particle.

Accordingly, the complex particles of Examples 1-2 to 1-14 have all the above Properties (1) to (8).

Evaluation of Complex Particles of Examples 1-2 to 1-14

The rest of complex particles except the complex particles of Examples 1-4, 1-7, and 1-10 showing ⌈B⌋ among the complex particles of Examples 1-2 to 1-14 show ⌈A⌋ in the adhesion strength evaluation of a shell particle to a core particle.

The rest of complex particles except the complex particles of Examples 1-4, 1-7, 1-10, and 1-13 showing ⌈B⌋ among the complex particles of Examples 1-2 to 1-14 show ⌈A⌋ in the flowability evaluation depending on an agglomeration degree change. The complex particles of Examples 1-2 to 1-14 have a satisfactory charge amount.

TABLE 3

| | | | Ex. 1-1 | Ex. 1-2 | Ex. 1-3 | Ex. 1-4 | Ex. 1-5 | Ex. 1-6 | Ex. 1-7 |
|---|---|---|---|---|---|---|---|---|---|
| | Organic core particle | Synthesis Example 1 (g) | 100 | 100 | 100 | 100 | 100 | | |
| | | Synthesis Example 2 (g) | | | | | | 100 | 100 |
| | | Synthesis Example 3 (g) | | | | | | | |
| | Inorganic shell particle | Synthesis Example 6 (g) | 313 | 200 | 60 | | | 60 | |
| | | Synthesis Example 7 (g) | | | | | | | 150 |
| | | Synthesis Example 8 (g) | | | | 150 | 70 | | |
| | | Synthesis Example 12 (g) | | | | | | | |
| | | Titanium oxide (g) | | | | | | | |
| | | Cerium oxide (g) | | | | | | | |
| | Water (g) | | 2087 | 2200 | 2340 | 2250 | 2330 | 2340 | 2250 |
| Coupling agent | 3-(trimethoxysilyl)propyl methacrylate (g) | | 50 | 50 | 50 | 50 | 50 | 50 | 50 |
| Hydrophobizing agent | Hexamethyl disilazane (g) | | 15 | 15 | 15 | 15 | 15 | 15 | 15 |
| | Water (g) | | 200 | 200 | 200 | 200 | 200 | 200 | 200 |
| Properties of external additive | Average particle diameter of organic core particle (nm) | | 80 | 80 | 80 | 80 | 80 | 205 | 205 |
| | Average particle diameter of inorganic shell particle (nm) | | 20 | 20 | 20 | 9 | 9 | 20 | 30 |
| | average particle diameter of shell particle/average particle diameter of core particle | | 0.250 | 0.250 | 0.250 | 0.113 | 0.113 | 0.098 | 0.146 |
| | Average particle diameter of composite Particle (nm) | | 122 | 125 | 124 | 176 | 101 | 250 | 331 |
| | Coating ratio (%) | | 37% | 22% | 5% | 10% | 53% | 35% | 25% |
| | $\rho_r$ | | 1.1 | 0.9 | 0.7 | 1.4 | 0.8 | 0.8 | 0.8 |
| | Relative permittivity | | 2.3 | 3.5 | 5.8 | 3.8 | 3.1 | 4.9 | 4.4 |
| | Adhesion strength | | A | A | A | B | A | A | B |
| | Charge amount (μC/g) | | −150 | −180 | −190 | −200 | −120 | −130 | −150 |
| | Flowability depending on agglomeration degree | | A | A | A | B | A | A | B |

| | | | Ex. 1-8 | Ex. 1-9 | Ex. 1-10 | Ex. 1-11 | Ex. 1-12 | Ex. 1-13 | Ex. 1-14 |
|---|---|---|---|---|---|---|---|---|---|
| | Organic core particle | Synthesis Example 1 (g) | | | | | 100 | 100 | |
| | | Synthesis Example 2 (g) | 100 | | | | | | |
| | | Synthesis Example 3 (g) | | 100 | 100 | 100 | | | 100 |
| | Inorganic shell particle | Synthesis Example 6 (g) | | 70 | 100 | | | | |
| | | Synthesis Example 7 (g) | | | | | | | |
| | | Synthesis Example 8 (g) | 30 | | | 22 | | | |
| | | Synthesis Example 12 (g) | | | | | 60 | | |
| | | Titanium oxide (g) | | | | | | 60 | |
| | | Cerium oxide (g) | | | | | | | 60 |
| | Water (g) | | 2370 | 2330 | 2300 | 2378 | 2340 | 2340 | 2340 |

TABLE 3-continued

| | | | | | | | | |
|---|---|---|---|---|---|---|---|---|
| Coupling agent | 3-(trimethoxysilyl)propyl methacrylate (g) | 50 | 50 | 50 | 50 | 50 | 50 | 50 |
| Hydro-phobizing agent | Hexamethyl disilazane (g) | 15 | 15 | 15 | 15 | 15 | 15 | 15 |
| | Water (g) | 200 | 200 | 200 | 200 | 200 | 200 | 200 |
| Properties of external additive | Average particle diameter of organic core particle (nm) | 205 | 300 | 300 | 300 | 80 | 80 | 300 |
| | Average particle diameter of inorganic shell particle (nm) | 9 | 20 | 20 | 9 | 18 | 9 | 5 |
| | average particle diameter of shell particle/ average particle diameter of core particle | 0.044 | 0.067 | 0.067 | 0.030 | 0.225 | 0.113 | 0.017 |
| | Average particle diameter of composite Particle (nm) | 234 | 342 | 350 | 319 | 115 | 90 | 320 |
| | Coating ratio (%) | 57% | 43% | 21% | 68% | 12% | 12% | 50% |
| | $\rho_r$ | 0.7 | 0.7 | 0.7 | 0.7 | 0.8 | 0.7 | 0.7 |
| | Relative permittivity | 2.4 | 3.9 | 4.1 | 2.1 | 280 | 100 | 28 |
| | Adhesion strength | A | A | B | A | A | A | A |
| | Charge amount (μC/g) | −100 | −130 | −190 | −150 | −100 | −110 | −120 |
| | Flowability depending on agglomeration degree | A | A | B | A | A | B | A |

Examples 2-1 to 2-8

Examples 2-1 to 2-8 are Preparation Example of a complex particle including one kind of inorganic core particle and one kind of organic shell particle.

Example 2-1

Preparation of Complex Particle of Example 2-1

1. Process of Forming Particle Adhesion Body 500 g of an inorganic particle dispersion liquid including 100 g of the silica particle (average particle diameter: 110 nm) according to Synthesis Example 9 at a liquid temperature of 30° C. and 888 g of an organic shell particle dispersion liquid including 160 g of the PMMA shell particle (average particle diameter: 8 nm) of Synthesis Example 5 at a liquid temperature of 30° C. are mixed in a reaction vessel having a condenser, a thermometer, and a nitrogen inlet, obtaining a dispersion liquid. Subsequently, distilled water is added thereto until the entire amount of the dispersion liquid becomes 2500 g. Then, the dispersion liquid is stirred for 3 hours while maintained at 30° C. Subsequently, a 0.1 M hydrochloric acid solution is added thereto in a drop wise fashion until it has pH 2.0 while stirred at the same liquid temperature and then, stopped when it reaches pH 2.0. The resultant is heated up to 60° C. and stirred for 5 hours at 60° C. to attach the PMMA shell particle on the surface of the silica core particle. 2. Process of Forming Complex Particle The dispersion liquid in which a particle adhesion body is formed is cooled down to room temperature, 50.0 g of MAPTMS is added thereto at one time, and a 10% ammonia solution is added thereto in a drop wise fashion over 2 hours until the dispersion liquid has pH 8.0, while the mixture is agitated. When the dispersion liquid has pH 8.0, and the obtained mixture is reacted at room temperature for 6 hours while the pH is maintained, obtaining a particle adhesion body having the silica particle on the surface of the core particle. Subsequently, 100 g of distilled water is added thereto, the mixture is concentrated with an evaporator until the amount of the mixture becomes a half, and a solid-liquid separation is performed through a centrifugal sedimentation. Then, a supernatant is removed therefrom through decantation, 300 g of distilled water is added thereto, and a solid-liquid separation is performed in the same method. Then, a series of operation of adding 300 g of distilled water, separating solid-liquid through a centrifugal sedimentation, and decantating a supernatant therefrom is three times in total repeated, and a precipitate therefrom is lyophilized for 24 hours, obtaining a white powder. 3. Particle Hydrophobizing Process 10 g of the white powder complex obtained from the particle forming process is added to a mixture of 200 g of water and 15 g of hexamethyldisilazane (HMDS), the obtained mixture is stirred at room temperature for 30 minutes and also, at 60° C. for 4 hours, and a precipitate obtained through a solid-liquid separation is cleaned and dried at 50° C. for 48 hours, obtaining white powder of complex particles having a hydrophobized surface (average particle diameter: 125 nm). Each amount of this organic particle of Example 2-1, an inorganic particle, water, MAPTMS, and HMDS are provided in Table 4. Confirmation of Properties of Complex Particle of Example 2-1.

The average particle diameter of the core particle of the complex particle according to Example 2-1, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio are provided in Tables 1, 2, and 4. In addition, the complex particle has a number change of less than 3% as shown in the adhesion strength evaluation of shell particles to the core particle. Accordingly, the complex particle of Example 2-1 has the above Properties (1) to (8). <Evaluation of Complex Particle of Example 2-1>

The complex particle of Example 2-1 is evaluated as ⌈B⌋ in the adhesion strength evaluation of shell particles to the core particle and as ⌈A⌋ in the flowability evaluation depending on an agglomeration degree. In addition, the complex particle of Example 2-1 has a satisfactory charge amount.

Examples 2-2 to 2-8

Preparation of Complex Particles of Examples 2-2 to 2-8

Complex particles of Examples 2-2 to 2-8 are prepared according to the same method as Example 2-1 except for changing each mixing amount of an organic particle, an inorganic particle, and water as shown in Table 4.

In Examples 2-2 to 2-8, each mixing amount of the organic particle, the inorganic particle, water, MAPTMS, and HMDS is provided in Table 4.

Confirmation of Properties of Complex Particles of Examples 2-2 to 2-8

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of each complex particle according to Examples 2-2 to 2-8 are provided in Tables 1, 2, and 4.

The complex particles of Examples 2-2 to 2-8 show a number change of less than 3% as shown in the adhesion strength evaluation of shell particles to the core particle.

Accordingly, each complex particle of Examples 2-2 to 2-8 has all the above Properties (1) to (8).

Evaluation of Complex Particles of Examples 2-2 to 2-8

The complex particles of Examples 2-2 to 2-8 are evaluated as ⌈A⌋ in the adhesion strength evaluation of the shell particles to the core particle.

The complex particle of Example 2-5 among the complex particles of Examples 2-2 to 2-8 is evaluated as ⌈B⌋ in the flowability evaluation depending on an agglomeration degree.

The complex particle of Examples 2-2 to 2-8 all have a satisfactory charge amount.

Example 3-1

Preparation of Complex Particle of Example 3-1

1. Process of Forming Particle Adhesion Body 555 g of an organic particle dispersion liquid including 100 g of the PMMA particle (average particle diameter: 80 nm) of Synthesis Example 1 at a liquid temperature of 30° C., 400 g of an inorganic particle dispersion liquid including 80 g of the silica shell particle of Synthesis Example 6 (average particle diameter: 20 nm) at a liquid temperature 30° C., and 1564 g of distilled water are mixed in a reaction vessel having a condenser, a thermometer, and a nitrogen inlet, preparing a dispersion liquid.

Subsequently, the dispersion liquid is stirred at 30° C. for 3 hours.

Then, a 0.1 M hydrochloric acid solution is added thereto in a drop wise fashion over 2 hours while the dispersion liquid is stirred at the liquid temperature until the dispersion liquid has pH 2.0, and the addition is stopped when the pH reaches 2.0.

Subsequently, the dispersion liquid is heated up to 60° C. and stirred at 60° C. for 5 hours to attach the silica shell particle on the surface of the PMMA core particle.

Then, 194 g of a dispersion liquid including 35 g of the PMMA shell particle (average particle diameter: 8 nm) synthesized according to Synthesis Example 5 and heated at 60° C. is immediately added thereto, and the obtained mixture is stirred at 60° C. for 5 hours, forming a particle adhesion body obtained by attaching the PMMA shell particle again on the surface of the PMMA core particle attached with the silica shell particles on the surface.

TABLE 4

| | | | Ex. 2-1 | Ex. 2-2 | Ex. 2-3 | Ex. 2-4 | Ex. 2-5 | Ex. 2-6 | Ex. 2-7 | Ex. 2-8 |
|---|---|---|---|---|---|---|---|---|---|---|
| | Inorganic core particle | Synthesis Example 9 (g) | 100 | 100 | 100 | 100 | | | | |
| | | Synthesis Example 10 (g) | | | | | 100 | 100 | | |
| | | Synthesis Example 11 (g) | | | | | | | 100 | 100 |
| | Organic shell particle | Synthesis Example 4 (g) | | | | | | | 50 | |
| | | Synthesis Example 5 (g) | 160 | 100 | 30 | 20 | 65 | 20 | | 250 |
| | Water (g) | | 2240 | 2300 | 2370 | 2380 | 2335 | 2380 | 2350 | 2150 |
| Coupling agent | 3-(trimethoxysilyl)propyl methacrylate (g) | | 50 | 50 | 50 | 50 | 50 | 50 | 50 | 50 |
| Hydrophobizing agent | Hexamethyldisilizane (g) | | 15 | 15 | 15 | 15 | 15 | 15 | 15 | 15 |
| | Water (g) | | 200 | 200 | 200 | 200 | 200 | 200 | 200 | 200 |
| Properties of external additive | Inorganic core particle average particle diameter (nm) | | 110 | 110 | 110 | 110 | 80 | 80 | 290 | 290 |
| | Average particle diameter of organic shell particle (nm) | | 8 | 8 | 8 | 8 | 8 | 8 | 30 | 8 |
| | Average particle diameter of the shell particle/average particle diameter of the core particle | | 0.073 | 0.073 | 0.073 | 0.073 | 0.100 | 0.100 | 0.103 | 0.028 |
| | Average particle diameter of composite particle (nm) | | 125 | 128 | 130 | 124 | 98 | 98 | 350 | 305 |
| | Coating ratio (%) | | 32% | 20% | 16% | 29% | 12% | 37% | 38% | 53% |
| | $\rho_r$ | | 1 | 0.9 | 0.8 | 1.1 | 0.8 | 0.8 | 0.7 | 0.8 |
| | Relative permittivity | | 4.4 | 3.6 | 2.8 | 2.5 | 5.1 | 3.8 | 4.1 | 2.4 |
| | Adhesion strength | | A | A | A | A | A | A | A | A |
| | Charge amount (μC/g) | | −230 | −200 | −150 | −220 | −160 | −200 | −190 | −180 |
| | Flowability depending on agglomeration degree | | B | A | A | A | B | A | A | A |

Examples 3-1 to 3-6

Examples 3-1 to 3-6 are Preparation Example of a complex particle including one kind of organic core particle, one kind of inorganic shell particle, and one kind of organic shell particle.

During this process, distilled water is added thereto until the amount of the dispersion liquid becomes 2500 g, and the total amount of the distilled water is 2285 g.

2. Process of Forming Complex Particle

The dispersion liquid in which the particle adhesion body is formed is cooled down to room temperature, 10.0 g of MAPTMS is added thereto at one time, and a 10% ammonia solution is slowly added thereto over 2 hours until the mixture has pH 8.0.

When the pH reaches 8.0, the resultant is reacted at room temperature for 6 hours while the same pH is maintained, obtaining a complex particle having the silica shell particles and the PMMA shell particles fixed on the surface of the PMMA core particle.

Subsequently, 100 g of distilled water is added thereto, the mixture is concentrated with an evaporator until the amount of the mixture becomes a half, and then, a product therefrom is solid-liquid separated through a centrifugal sedimentation.

Then, a supernatant is removed therefrom through decantation, 300 g of distilled water is added thereto, and a solid-liquid separation is performed in the same way.

Then, a series of operation of adding 800 g of distilled water, separating solid-liquid through a centrifugal sedimentation, and decantating a supernatant therefrom is three times in total repeated, and a precipitate therefrom is lyophilized for 24 hours, obtaining white powder.

3. Particle Hydrophobizing Process 10 g of the white powder obtained through the process of forming a complex particle is added to a mixture of 200 g of water and 15 g of hexamethyldisilazane (HMDS), the obtained mixture is stirred at room temperature for 30 minutes and also, at 60° C. for 4 hours, a solid-liquid separation is performed, and a precipitate obtained therefrom is cleaned in methanol and dried at 50° C. for 48 hours, obtaining white powder of the complex particle having a hydrophobized surface (average particle diameter examined through an SEM image: 123 nm).

Each mixing amount of an organic particle, an inorganic particle, water, MAPTMS, and HMDS in Example 3-1 is provided in Table 5.

Confirmation of Properties of Complex Particle of Example 3-1

The average particle diameter of the core particle of the complex particle according to Example 3-1, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio are provided in Tables 1, 2, and 4.

In addition, the complex particle has a number change of less than 3% as shown in the adhesion strength evaluation of shell particles to the core particle.

Accordingly, the complex particle of Example 3-1 has all the above Properties (1) to (8).

Evaluation of Complex Particle of Example 3-1

The complex particle of Example 3-1 is evaluated as ⌈A⌋ in the adhesion strength evaluation of shell particles to the core particle and the flowability evaluation depending on an agglomeration degree.

In addition, the complex particle Example 3-1 has a satisfactory charge amount.

Examples 3-2 to 3-6

Preparation of Complex Particles of Examples 3-2 to 3-6

Each complex particle of Examples 3-2 to 3-6 is prepared according to the same method as Example 3-1 except for changing each mixing amount of an organic particle, an inorganic particle, and water as shown in Table 5.

Each mixing amount of the organic particle, the inorganic particle, the water, the MAPTMS, and the HMDS in Examples 3-2 to 3-6 is provided in Table 5.

Confirmation of Properties of Complex Particles of Examples 3-2 to 3-6

The average particle diameters of the core particles, a coefficient of variation of the average particle diameters, a ratio of an average particle diameter of the shell particle/an average particle diameter of the core particle, a resistance ratio $\rho_r$, the average particle diameter of the complex particle, relative permittivity, and a coating ratio of the complex particles according to Examples 3-2 to 3-6 are provided in Tables 1, 2, and 5.

Each complex particle of Examples 3-2 to 3-6 has a number change of less than 3% in the adhesion strength evaluation of shell particles to the core particle.

Accordingly, each complex particle of Examples 3-2 to 3-6 has all the above Properties (1) to (8).

Evaluation of Complex Particles of Examples 3-2 to 3-6

The complex particles of Examples 3-2 to 3-6 are evaluated as ⌈A⌋ in the adhesion strength evaluation of shell particles to the core particle.

The complex particles of Examples 3-2 and 3-5 among the complex particles of Example 3-2 to 3-6 are evaluated as ∃B⌋ in the flowability evaluation depending on an agglomeration degree change, while the rest of the complex particles are all evaluated as ⌈A⌋.

The complex particles of Examples 3-2 to 3-6 all have a satisfactory charge amount.

TABLE 5

| | | | Ex. 3-1 | Ex. 3-2 | Ex. 3-3 | Ex. 3-4 | Ex. 3-5 | Ex. 3-6 |
|---|---|---|---|---|---|---|---|---|
| | Organic core particle | Synthesis Example 1 (g) | 100 | 100 | 100 | 100 | 100 | 100 |
| | Inorganic shell particle | Synthesis Example 6 (g) | 80 | 40 | | 80 | 40 | |
| | | Synthesis Example 8 (g) | | | 55 | | | 55 |
| | organic shell particle | Synthesis Example 5 (g) | 35 | 35 | 35 | 35 | 35 | 35 |
| | Water (g) | | 2285 | 2325 | 2310 | 2285 | 2325 | 2310 |
| Coupling agent | 3-(trimethoxysilyl)propyl methacrylate (g) | | 50 | 50 | 50 | 50 | 50 | 50 |
| Hydrophobizing agent | Hexamethyldisliazane (g) | | 15 | 15 | 15 | 15 | 15 | 15 |

TABLE 5-continued

| | | Ex. 3-1 | Ex. 3-2 | Ex. 3-3 | Ex. 3-4 | Ex. 3-5 | Ex. 3-6 |
|---|---|---|---|---|---|---|---|
| | Water (g) | 200 | 200 | 200 | 200 | 200 | 200 |
| Properties of external additive | Average particle diameter of Organic core particle (nm) | 80 | 80 | 80 | 80 | 80 | 80 |
| | Average particle diameter of inorganic shell particle (nm) | 20 | 20 | 9 | 20 | 20 | 9 |
| | Average particle diameter of organic shell particle (nm) | 8 | 8 | 8 | 8 | 8 | 8 |
| | Average particle diameter of inorganic shell particle/average particle diameter of core particle | 0.250 | 0.250 | 0.113 | 0.250 | 0.250 | 0.113 |
| | Average particle diameter of the organic shell particle/average particle diameter of the core particle | 0.100 | 0.100 | 0.100 | 0.100 | 0.100 | 0.100 |
| | Average particle diameter of composite particle (nm) | 123 | 126 | 102 | 126 | 128 | 105 |
| | Coating ratio (%) | 21% | 11% | 32% | 21% | 12% | 36% |
| | $\rho_r$ | 0.9 | 1.1 | 0.7 | 0.8 | 1.2 | 0.7 |
| | Relative permittivity | 4.9 | 4.1 | 3.6 | 4.4 | 3.8 | 3.5 |
| | Adhesion strength | A | A | A | A | A | A |
| | Charge amount (μC/g) | −210 | −250 | −190 | −180 | −210 | −200 |
| | Flowability depending on agglomeration degree | A | B | A | A | B | A |

Examples 4-1 to 4-6

Examples 4-1 to 4-6 are a Preparation Example of a complex particle including an inorganic core particle and one kind of organic shell particle, and one kind of inorganic shell particle.

Example 4-1

Preparation of Complex Particle of Example 4-1

1. Process of Forming Particle Adhesion Body 500 g of an inorganic particle dispersion liquid including 100 g of the silica particle (average particle diameter: 110 nm) synthesized according to Synthesis Example 9 at a liquid temperature of 30° C. and 167 g of an organic shell particle dispersion liquid including 30 g of the PMMA shell particle (average particle diameter: 8 nm) synthesized according to Synthesis Example 5 at a liquid temperature of 30° C., and 1863 g of distilled water are mixed in a reaction vessel including a condenser, a thermometer, and an nitrogen inlet, obtaining a dispersion liquid.

The dispersion liquid is stirred at 30° C. for 3 hours.

Subsequently, a 0.1 M hydrochloric acid solution is added thereto in a drop wise fashion over 2 hours until pH of the dispersion liquid becomes 2.0 while the liquid temperature and the stirring speed are maintained.

Then, the mixture is heated up to 60° C. and stirred at the same temperature for 5 hours, attaching PMMA shell particles to the surface of the silica core particle.

Subsequently, 125 g of a dispersion liquid including 25 g of the silica shell particle (average particle diameter: 20 nm) synthesized according to Synthesis Example 6 and heated at 60° C. in advance is immediately added thereto, and the obtained mixture is stirred at 60° C. for 5 hours, forming a particle adhesion body by attaching silica shell particles on the surface of the silica core particle attached with the PMMA shell particles on the surface.

During this process, distilled water is added thereto until the entire amount of the dispersion liquid becomes 2500 g, and herein, the amount of the distilled water is 2345 g.

2. Process of Forming Complex Particle

The dispersion liquid in which the particle adhesion body is formed is cooled down to room temperature, 10.0 g of MAPTMS is added thereto at one time dispersion liquid, and a 10% ammonia solution is slowly added thereto in a drop wise fashion over 2 hours until the pH reaches 8.0.

When the dispersion liquid has pH 8.0, the mixture is reacted at room temperature for 6 hours while the pH is maintained, obtaining a complex particle having PMMA shell particles and silica shell particles on the surface of the silica core particle.

Subsequently, 100 g of distilled water is added thereto, the mixture is concentrated with an evaporator, and a solid-liquid separation is performed through centrifugal sedimentation.

Then, a supernatant is removed therefrom through decantation, 300 g of distilled water is added thereto, and a solid-liquid separation is performed in the same way.

Then, a series of operation of adding 800 g of distilled water, separating solid-liquid through a centrifugal sedimentation, and decantating a supernatant therefrom is three times in total repeated, and a precipitate obtained therefrom is lyophilized for 24 hours, obtaining white powder.

3. Particle Hydrophobizing Process 10 g of the white powder obtained through the process of forming a complex particle is added to a mixture of 200 g of water and 15 g of hexamethyldisilazane (HMDS), the obtained mixture is stirred at room temperature for 30 minutes and also, at 60° C. for 4 hours, and a precipitate obtained through a solid-liquid separation is cleaned in methanol and dried at 50° C. for 48 hours, obtaining white powder (average particle diameter examined through an SEM image: 153 nm) of the complex particle having a hydrophobized surface.

In Example 4-1, each mixing amount of an organic particle, an inorganic particle, water, MAPTMS, and HMDS is provided in Table 6.

Confirmation of Properties of Complex Particle of Example 4-1

The average particle diameter of the core particle of the complex particle according to Example 4-1, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio are provided in Tables 1, 2, and 6.

In addition, the complex particle has a number change of less than 3% as shown in the adhesion strength evaluation of shell particles to the core particle.

Accordingly, the complex particle of Example 4-1 has all the above Properties (1) to (8).

Evaluation of Complex Particle of Example 4-1

The complex particle of Example 4-1 is evaluated as ⌈A⌋ in the adhesion strength of shell particles to the core particle and the flowability evaluation depending on an agglomeration degree change.

In addition, the complex particle of Example 4-1 has a satisfactory charge amount.

Examples 4-2 to 4-6

Preparation of Complex Particles of Examples 4-2 to 4-6

The complex particles of Example 4-2 to 4-6 are prepared according to the same method as Example 4-1 except for changing Each mixing amount of an organic particle, an inorganic particle, and water as shown in Table 6.

Each mixing ration of an organic particle, an inorganic particle, water, MAPTMS, and HMDS in Examples 4-2 to 4-6 is shown in Table 6.

Confirmation of Properties of Complex Particles of Examples 4-2 to 4-6

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of each complex particle according to Examples 4-2 to 4-6 are provided in Tables 1, 2, and 6.

Each complex particle of Examples 4-2 to 4-6 has a number change of less than 3% as shown in the adhesion strength evaluation of shell particles to the core particle.

Accordingly, each complex particle of Examples 4-2 to 4-6 has all the above Properties (1) to (8).

Evaluation of Complex Particles of Examples 4-2 to 4-6

The complex particles of Examples 4-2 to 4-6 are evaluated as ⌈A⌋ in the adhesion strength evaluation of shell particles to the core particle.

Among the complex particles of Examples 4-2 to 4-6, the complex particle of Example 4-2 is evaluated as ⌈B⌋ in the flowability evaluation depending on an agglomeration degree change, while the rest is evaluated as ⌈A⌋.

The complex particles of Examples 4-2 to 4-6 have a satisfactory charge amount.

TABLE 6

| | | | Ex. 4-1 | Ex. 4-2 | Ex. 4-3 | Ex. 4-4 | Ex. 4-5 | Ex. 4-6 |
|---|---|---|---|---|---|---|---|---|
| | Inorganic core particle | Synthesis Example 9 (g) | 100 | 100 | 100 | 100 | 100 | 100 |
| | Organic shell particle | Synthesis Example 5 (g) | 30 | 30 | 30 | 30 | 30 | 30 |
| | Inorganic shell particle | Synthesis Example 6 (g) | 50 | 25 | | 50 | 25 | |
| | | Synthesis Example 8 (g) | | | 90 | | | 90 |
| | Water (g) | | 2320 | 2345 | 2280 | 2320 | 2345 | 2280 |
| Coupling agent | 3-(trimethoxy)propyl methacrylate (g) | | 50 | 50 | 50 | 50 | 50 | 50 |
| Hydrophobizing agent | Hexamethyldisliazane (g) | | 15 | 15 | 15 | 15 | 15 | 15 |
| | Water (g) | | 200 | 200 | 200 | 200 | 200 | 200 |
| Properties of external additive | Average particle diameter of inorganic core particle (nm) | | 110 | 110 | 110 | 110 | 110 | 110 |
| | Average particle diameter of organic shell particle (nm) | | 8 | 8 | 8 | 8 | 8 | 8 |
| | Average particle diameter of inorganic shell particle (nm) | | 20 | 20 | 9 | 20 | 20 | 9 |
| | Average particle diameter of organic shell particle/average particle diameter of core particle | | 0.073 | 0.073 | 0.073 | 0.073 | 0.073 | 0.073 |
| | Average particle diameter of inorganic shell particle/average particle diameter of core particle | | 0.182 | 0.182 | 0.082 | 0.182 | 0.182 | 0.082 |
| | Average particle diameter of composite particle (nm) | | 153 | 157 | 131 | 130 | 128 | 134 |
| | Coating ratio (%) | | 17% | 20% | 31% | 24% | 16% | 37% |
| | $\rho_r$ | | 0.7 | 0.9 | 1.1 | 0.8 | 0.9 | 0.9 |
| | Relative permittivity | | 3.1 | 2.5 | 3.8 | 3.5 | 2.9 | 4.1 |
| | Adhesion strength | | A | A | A | A | A | A |
| | Charge amount(μC/g) | | −140 | −180 | −110 | −130 | −150 | −120 |
| | Flowability depending on agglomeration degree | | A | B | A | A | A | A |

Comparative Example 1

Preparation of Complex Particle of Comparative Example 1

A complex particle of Comparative Example 1 is prepared according to the same method as Example 1-1 except for not surface-treating with MAPTMS a particle adhesion body obtained by attaching the silica shell particle (average particle diameter: 20 nm) synthesized according to Synthesis Example 6 to the PMMA core particle (average particle diameter: 80 nm) synthesized according to Synthesis Example 1.

Each mixing amount of an organic particle, an inorganic particle, water, and HMDS in Comparative Example 1 is shown in Table 7.

Confirmation of Properties of Complex Particle of Comparative Example 1

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 1 are provided in Tables 1, 2, and 7.

The complex particle of Comparative Example 1 has a number change of greater than or equal to 5% and less than 10% as shown in the adhesion strength evaluation of shell particles to the core particle and a resistance ratio $\rho_r$ of 1.5 and satisfies the numeral range of the above Property (5).

Evaluation of Complex Particle of Comparative Example 1

The complex particle of Comparative Example 1 is evaluated as in the adhesion strength evaluation of shell particles to the core particle, the flowability evaluation depending on an agglomeration degree change and shows −320 of a lower charge amount than the appropriate range.

Accordingly, not a few complex particle of Comparative Example 1 loses flowability and also, shows a small charge amount.

This evaluation result is caused, since the resistance ratio $\rho_r$ of the complex particle according to Comparative Example 1 does not satisfy the numeral range of the Property (5).

Comparative Example 2

Preparation of Complex Particle of Comparative Example 2

A complex particle of Comparative Example 2 is prepared according to the same method as Example 1-4 except for not surface-treating with MAPTMS the particle adhesion body having the silica shell particles (average particle diameter: 30 nm) synthesized according to Synthesis Example 7 attached to the PMMA core particle (average particle diameter: 80 nm) synthesized according to Synthesis Example 1.

Each mixing amount of an organic particle, an inorganic particle, water, and HMDS in Comparative Example 2 is provided in Table 7.

Confirmation of Properties of Complex Particle of Comparative Example 2

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 2 are provided in Tables 1, 2, and 7.

The complex particle of Comparative Example 2 has a number change of greater than or equal to 10% as shown in the adhesion strength evaluation of shell particles to the core particle and a resistance ratio $\rho_r$ of 3, which do not satisfy the numeral ranges of the above Properties (5) and (6).

Evaluation of Complex Particle of Comparative Example 2

The complex particle of Comparative Example 2 is all evaluated as ⌈D⌋ as shown in the adhesion strength evaluation of shell particles to the core particle and the flowability evaluation depending on an agglomeration degree change.

Accordingly, the complex particle of Comparative Example 2 has low adhesion strength and loses flowability.

This evaluation result is caused, since the number change and resistance ratio $\rho_r$ of the complex particle of Comparative Example 2 do not satisfy the numeral ranges of the Properties (5) and (6). Comparative Example Preparation of Complex Particle of Comparative Example 3

The complex particle of Comparative Example 3 is prepared according to the same method as Example 1-5 except for not surface-treating with MAPTMS the particle adhesion body having silica shell particles (average particle diameter: 9 nm) synthesized according to Synthesis Example 8 to the PMMA core particle (average particle diameter: 80 nm) synthesized according to Synthesis Example 1.

Each mixing amount of an organic particle, an inorganic particle, water, and HMDS in Comparative Example 3 is shown in Table 7.

Confirmation of Properties of Complex Particle of Comparative Example 3

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 3 are provided in Tables 1, 2, and 7.

The complex particle of Comparative Example 3 has a number change of greater than or equal to 5% and less than 10% as shown in the adhesion strength evaluation of shell particles to the core particle and a resistance ratio $\rho_r$ of 1.6, which do not satisfy the numeral ranges of the above Properties (5) and (6).

Evaluation of Complex Particle of Comparative Example 3

The complex particle of Comparative Example 3 is evaluated ⌈C⌋ in the adhesion strength evaluation of shell particles to the core particle and as ⌈B⌋ in the flowability evaluation depending on an agglomeration degree change and also, has −350 of a lower charge amount than an appropriate range.

Accordingly, the complex particle of Comparative Example 3 has very low adhesion strength and loses flowability.

This evaluation result is caused, since the complex particle of Comparative Example 3 has a number change and a resistance ratio $\rho_r$ which do not satisfy the numeral ranges of the Properties (5) and (6).

Comparative Example 4

Preparation of Complex Particle of Comparative Example 4

The complex particle of Comparative Example 4 is prepared according to the same method as Example 1-6 except for not surface-treating with MAPTMS the particle adhesion body having silica shell particles (average particle diameter: 20 nm) synthesized according to Synthesis Example 6 to the PMMA core particle (average particle diameter: 205 nm) synthesized according to Synthesis Example 2.

Each mixing amount of an organic particle, an inorganic particle, water, and HMDS in Comparative Example 4 is shown in Table 7.

Confirmation of Properties of Complex Particle of Comparative Example 4

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 4 are provided in Tables 1, 2, and 7.

The complex particle of Comparative Example 4 has a number change of greater than or equal to 5% and less than 10% as shown in the adhesion strength evaluation of shell particles to the core particle and a resistance ratio $\rho_r$ of 1.5, which do not satisfy the numeral ranges of the above Properties (5) and (6).

Evaluation of Complex Particle of Comparative Example 4

The complex particle of Comparative Example 4 is evaluated [C] in the adhesion strength evaluation of shell particles to the core particle and in the flowability evaluation depending on an agglomeration degree change and also, has −400 of a lower charge amount than an appropriate range. Accordingly, the complex particle of Comparative Example 4 has very low adhesion strength and loses flowability.

This evaluation result is caused, since the complex particle of Comparative Example 4 has a number change and a resistance ratio $\rho_r$ which do not satisfy the numeral ranges of the Properties (5) and (6).

Comparative Example 5

Preparation of Complex Particle of Comparative Example 5

The complex particle of Comparative Example 5 is prepared according to the same method as Example 1-9 except for not surface-treating with MAPTMS the particle adhesion body having silica shell particles (average particle diameter: 20 nm) synthesized according to Synthesis Example 6 to the PMMA core particle (average particle diameter: 300 nm) synthesized according to Synthesis Example 3.

Each mixing amount of an organic particle, an inorganic particle, water, and HMDS in Comparative Example 5 is shown in Table 7.

Confirmation of Properties of Complex Particle of Comparative Example 5

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 5 are provided in Tables 1, 2, and 7.

The complex particle of Comparative Example 3 has a number change of greater than or equal to 5% and less than 10% as shown in the adhesion strength evaluation of shell particles to the core particle and a resistance ratio $\rho_r$ of 1.5, which do not satisfy the numeral ranges of the above Properties (5) and (6).

Evaluation of Complex Particle of Comparative Example 5

The complex particle of Comparative Example 5 is evaluated [C] in the adhesion strength evaluation of shell particles to the core particle and in the flowability evaluation depending on an agglomeration degree change and also, has −330 of a lower charge amount than an appropriate range.

Accordingly, the complex particle of Comparative Example 5 has very low adhesion strength and loses flowability.

This evaluation result is caused, since the complex particle of Comparative Example 5 has a number change and a resistance ratio $\rho_r$ which do not satisfy the numeral ranges of the Properties (5) and (6).

Comparative Example 6

Preparation of Complex Particle of Comparative Example 6

The complex particle of Comparative Example 6 is prepared according to the same method as Example 2-2 except for not surface-treating with MAPTMS the complex particle having the PMMA shell particles (average particle diameter: 9 nm) synthesized according to Synthesis Example 5 on the silica core particle (average particle diameter: 110 nm) synthesized according to Synthesis Example 9.

Each mixing amount of an organic particle, an inorganic particle, water, and HMDS in Comparative Example 6 is shown in Table 7.

Confirmation of Properties of Complex Particle of Comparative Example 6

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 6 are provided in Tables 1, 2, and 7.

The complex particle of Comparative Example 6 has a number change of greater than or equal to 5% and less than 10% as shown in the adhesion strength evaluation of shell particles to the core particle and a resistance ratio $\rho_r$ of 1.5, which do not satisfy the numeral ranges of the above Properties (5) and (6).

Evaluation of Complex Particle of Comparative Example 6

The complex particle of Comparative Example 3 is evaluated [B] in the adhesion strength evaluation of shell particles to the core particle and in the flowability evaluation depending on an agglomeration degree change and also, has −420 of a lower charge amount than an appropriate range.

Accordingly, the complex particle of Comparative Example 6 has low adhesion strength and loses flowability.

This evaluation result is caused, since the complex particle of Comparative Example 6 has a number change and a resistance ratio $\rho_r$ which do not satisfy the numeral ranges of the Properties (5) and (6).

Comparative Example 7

Preparation of Complex Particle of Comparative Example 7

The complex particle of Comparative Example 7 is prepared according to the same method as Example 2-5 except for not surface-treating with MAPTMS the complex particle having silica shell particles (average particle diameter: 8 nm) synthesized according to Synthesis Example 5 on the PMMA core particle (average particle diameter: 80 nm) synthesized according to Synthesis Example 10.

Each mixing amount of an organic particle, an inorganic particle, water, and HMDS in Comparative Example 7 is shown in Table 7.

Confirmation of Properties of Complex Particle of Comparative Example 7

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 7 are provided in Tables 1, 2, and 7.

The complex particle of Comparative Example 7 has a number change of greater than or equal to 10% as shown in the adhesion strength evaluation of shell particles to the core particle and a resistance ratio $\rho_r$ of 1.5, which do not satisfy the numeral ranges of the above Properties (5) and (6).

Evaluation of Complex Particle of Comparative Example 7

The complex particle of Comparative Example 7 is evaluated ⌈D⌋ in the adhesion strength evaluation of shell particles to the core particle and as ⌈C⌋ in the flowability evaluation depending on an agglomeration degree change and also, has −460 of a lower charge amount than an appropriate range.

Accordingly, the complex particle of Comparative Example 7 has very low adhesion strength and loses flowability.

This evaluation result is caused, since the complex particle of Comparative Example 3 has a number change and a resistance ratio $\rho_r$ which do not satisfy the numeral ranges of the Properties (5) and (6).

Comparative Example 8

Preparation of Complex Particle of Comparative Example 8

The complex particle of Comparative Example 8 is prepared according to the same method as Example 2-7 except for not surface-treating with MAPTMS the complex particle having PMMA shell particle (average particle diameter: 8 m) synthesized according to Synthesis Example 5 to the silica core particle (average particle diameter: 290 m) synthesized according to Synthesis Example 11.

Each mixing amount of an organic particle, an inorganic particle, water, and HMDS in Comparative Example 8 is shown in Table 7.

Confirmation of Properties of Complex Particle of Comparative Example 8

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 8 are provided in Tables 1, 2, and 7.

The complex particle of Comparative Example 3 has a number change of greater than or equal to 5% and less than 10% as shown in the adhesion strength evaluation of shell particles to the core particle and a resistance ratio $\rho_r$ of 1.5, which do not satisfy the numeral ranges of the above Properties (5) and (6).

Evaluation of Complex Particle of Comparative Example 8

The complex particle of Comparative Example 8 is evaluated ⌈C⌋ in the adhesion strength evaluation of shell particles to the core particle and in the flowability evaluation depending on an agglomeration degree change and also, has −390 of a lower charge amount than an appropriate range.

Accordingly, the complex particle of Comparative Example 8 has low adhesion strength and loses flowability.

This evaluation result is caused, since the complex particle of Comparative Example 8 has a number change and a resistance ratio $\rho_r$ which do not satisfy the numeral ranges of the Properties (5) and (6).

Comparative Example 9

Preparation of Particle of Comparative Example 9

A particle of Comparative Example 3 is prepared according to the same method as Example 2-1 except for hydrophobizing the surface of the silica particle (average particle diameter: 110 nm) synthesized according to Synthesis Example 9 with hexamethyldisilazane (HMDS).

This particle of Comparative Example 9 is not a complex particle but an inorganic particle and is not surface-treated on the surface with MAPTMS.

Each mixing amount of an organic particle, an inorganic particle, water, and HMDS in Comparative Example 9 is shown in Table 7.

Confirmation of Properties of Particle of Comparative Example 9

The average particle diameter of the core particle of the particle according to Comparative Example 9, a coefficient of variation of the average particle diameter, a resistance ratio $\rho_r$, and relative permittivity are provided in Tables 1, 2, and 7.

The particle of Comparative Example 9 is not a complex particle and does not satisfy the numeral ranges of the above Properties (3) and (6).

Particle Evaluation of Comparative Example 9

The particle of Comparative Example 9 is evaluated as ⌈C⌋ in the flowability evaluation depending on an agglomeration degree change.

Accordingly, the particle of Comparative Example 9 loses flowability.

This evaluation result is caused, since the particle is detached from an acrylic resin and moved toward a ferrite resin when stirred with a tubular mixer.

Comparative Example 10

Preparation of Particle of Comparative Example 10

As for a particle of Comparative Example 10, the PMMA particle (average particle diameter: 80 nm) according to Synthesis Example 1 itself is used.

This particle of Comparative Example 10 is not a complex particle but an organic particle and not surface-treated with MAPTMS.

Each mixing amount of an organic particle, an inorganic particle, and water in Comparative Example 10 is shown in Table 7.

Confirmation of Properties of Complex Particle of Comparative Example 10

The average particle diameter of the core particle of the particle according to Comparative Example 3, a coefficient of variation of the average particle diameter, a resistance ratio $\rho_r$, and relative permittivity are provided in Tables 1, 2, and 7.

The particle of Comparative Example 10 is not a complex particle and does not satisfy the numeral ranges of the above Properties (3) and (6).

Evaluation of Complex Particle of Comparative Example 10

The particle of Comparative Example 10 is evaluated as ⌈D⌋ in the flowability evaluation depending on an agglomeration degree change Accordingly, the particle of Comparative Example 10 loses flowability. This evaluation result is caused, since the particle is detached from an acrylic resin and moves toward a ferrite resin when stirred with a tubular mixer.

In addition, the particle has a charge amount of −480, which is not controlled within the appropriate range.

Comparative Example 11

Preparation of Complex Particle of Comparative Example 11

The complex particle of Comparative Example 11 is prepared by attaching the silica shell particles (average particle diameter: 20 nm) according to Synthesis Example 6 to the PMMA core particle (average particle diameter: 80 nm) according to Synthesis Example 1, not surface-treating a product therefrom with MAPTMS but stirring it with a tubular mixer for 30 minutes, adding 200 g of water and 15 g of hexamethyldisilazane (HMDS) thereto, stirring the mixture at room temperature for 30 minutes and also, at 60° C. for 4 hours, performing a solid-liquid separation, cleaning a precipitate obtained therefrom in methanol, and drying it for 48 hours.

Each mixing amount of an organic particle, an inorganic particle, water, and HMDS in Comparative Example 11 is shown in Table 7.

Confirmation of Properties of Complex Particle of Comparative Example 11

The average particle diameter of the core particle, a coefficient of variation of the average particle diameter, a ratio of an average particle diameter of the shell particle/an average particle diameter of the core particle, a resistance ratio $\rho_r$, the average particle diameter of the complex particle, relative permittivity, and a coating ratio of the complex particle according to Comparative Example 11 are provided in Tables 1, 2, and 7.

The complex particle of Comparative Example 11 has a number change of greater than or equal to 10% as shown in the adhesion strength evaluation of shell particles to the core particle and a resistance ratio $\rho_r$ of 1.5, which do not satisfy the numeral ranges of the above Properties (5) and (6).

Evaluation of Complex Particle of Comparative Example 11

The complex particle of Comparative Example 11 is evaluated as ⌈D⌋ in the adhesion strength evaluation of shell particles to the core particle and in the flowability evaluation depending on an agglomeration degree change and also, has −350 of a lower charge amount than an appropriate range.

Accordingly, the complex particle of Comparative Example 11 has low adhesion strength and loses flowability.

This evaluation result is caused, since the complex particle of Comparative Example 11 has no sufficient adhesion strength between core particle and shell particle.

TABLE 7

| | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Organic core particle | Synth. Ex. 1 (g) | 100 | 100 | 100 | | | |
| | Synth. Ex. 2 (g) | | | | 100 | | |
| | Synth. Ex. 3 (g) | | | | | 100 | |
| Inorganic core particle | Synth. Ex. 9 (g) | | | | | | 100 |
| | Synth. Ex. 10 (g) | | | | | | |
| | Synth. Ex. 11 (g) | | | | | | |
| Organic shell particle | Synth. Ex. 5 (g) | | | | | | 100 |

TABLE 7-continued

| | | | | | | | | |
|---|---|---|---|---|---|---|---|---|
| | Inorganic shell particle | Synth. Ex. 6 (g) | 313 | | | 60 | 70 | |
| | | Synth. Ex. 7 (g) | | 150 | | | | |
| | | Synth. Ex. 8 (g) | | | 70 | | | |
| | Water (g) | | 2087 | 2250 | 2330 | 2340 | 2330 | 2300 |
| Coupling agent | 3-(trimethoxysilyl)propyl methacrylate (g) | | | | | | | |
| Hydrophobizing agent | Hexamethyldisliazane (g) | | 15 | 15 | 15 | 15 | 15 | 15 |
| | Water (g) | | 200 | 200 | 200 | 200 | 200 | 200 |
| Properties of external additive | Average particle diameter of core particle (nm) | | 80 | 80 | 80 | 205 | 300 | 110 |
| | Average particle diameter of shell particle (nm) | | 20 | 30 | 9 | 20 | 20 | 8 |
| | Avg. particle diameter of shell particle/Avg particle diameter of core particle | | 0.250 | 0.375 | 0.113 | 0.098 | 0.067 | 0.073 |
| | Average particle diameter of composite particle (nm) | | 121 | 186 | 98 | 250 | 355 | 140 |
| | Coating ratio (%) | | 13% | 10% | 34% | 16% | 22% | 11% |
| | $\rho_r$ | | 1.5 | 1.5 | 1.6 | 1.5 | 1.5 | 1.5 |
| | Relative permittivity | | 3.4 | 3.9 | 3.1 | 5.1 | 4.3 | 3.5 |
| | Adhesion strength | | C | D | C | C | C | C |
| | Charge amount (μC/g) | | −320 | −300 | −350 | −400 | −330 | −420 |
| | Flowability depending on agglomeration degree | | C | D | B | C | C | C |

| | | | Comp. Ex. 7 | Comp. Ex. 8 | Comp. Ex. 9 | Comp. Ex. 10 | Comp. Ex. 11 |
|---|---|---|---|---|---|---|---|
| | Organic core particle | Synth. Ex. 1 (g) | | | | 100 | 100 |
| | | Synth. Ex. 2 (g) | | | | | |
| | | Synth. Ex. 3 (g) | | | | | |
| | Inorganic core particle | Synth. Ex. 9 (g) | | | 100 | | |
| | | Synth. Ex. 10 (g) | 100 | | | | |
| | | Synth. Ex. 11 (g) | | 100 | | | |
| | Organic shell particle | Synth. Ex. 5 (g) | 65 | 255 | | | |
| | Inorganic shell particle | Synth. Ex. 6 (g) | | | | | 313 |
| | | Synth. Ex. 7 (g) | | | | | |
| | | Synth. Ex. 8 (g) | | | | | |
| | Water (g) | | 2335 | 2145 | | | |
| Coupling agent | 3-(trimethoxysilyl)propyl methacrylate (g) | | | | | | |
| Hydrophobizing agent | Hexamethyldisliazane (g) | | 15 | 15 | 15 | | 15 |
| | Water (g) | | 200 | 200 | 200 | | 200 |
| Properties of external additive | Average particle diameter of core particle (nm) | | 80 | 290 | 110 | 80 | 80 |
| | Average particle diameter of shell particle (nm) | | 8 | 8 | | | 20 |
| | Avg. particle diameter of shell particle/Avg particle diameter of core particle | | 0.100 | 0.028 | | | 0.250 |
| | Average particle diameter of composite particle (nm) | | 125 | 310 | — | — | 135 |
| | Coating ratio (%) | | 10% | 28% | — | — | 5% |
| | $\rho_r$ | | 1.5 | 1.5 | 1.4 | 1.1 | 1.5 |
| | Relative permittivity | | 5.3 | 4.2 | 3.1 | 5.8 | 3.5 |
| | Adhesion strength | | D | C | — | — | D |
| | Charge amount (μC/g) | | −460 | −390 | −120 | −480 | −350 |
| | Flowability depending on agglomeration degree | | C | C | C | D | D |

The above Examples illustrate that when a complex particle according to one embodiment is applied to an external additive for a toner, the complex particle secures adhesion strength of a shell particle on a core particle, a satisfactory charge amount, and high flowability required of the external additive for a toner, but when the complex particle is applied to other usages such as a powder pigment, a water repellent, a display, an antireflective film (an antiglare film), and the like, the same effect as the above Examples and may be appropriately used depending on a usage.

In the above Examples, the complex particle according to one embodiment includes one core particle including one kind of organic material or inorganic material as a main component, but the present invention is not limited thereto and may, for example, include one-bodied core particle including more than one kind of organic material or inorganic material shown as C1, C2, C3 . . . Cn shown in FIG. 1 as a main component.

A complex particle including the one-bodied core particle of more than one kind of particle may bring about the same effect as the above Examples. In addition, the above Examples use an acrylic resin as an organic material forming an organic core particle or an organic shell particle, the present invention is not limited thereto and other organic materials such as a polyester resin, an epoxy resin, a urethane resin, and the like may bring about the same effect as the above Examples.

In addition, the above Examples use silica as an inorganic material forming an inorganic core particle or an inorganic shell particle, but the present invention is not limited thereto but uses other inorganic materials and thus may bring about the same effect as the above Examples.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A complex particle comprising:

a core particle and a shell particle, wherein the shell particle is disposed on the core particle, wherein the core particle comprises an organic material or an inorganic material as a primary component and the shell particle comprises the other of the organic material and the inorganic material as a primary component, wherein an average particle diameter of the core particle is greater than or equal to about 80 nanometers and less than or equal to about 300 nanometers, a coefficient of variation of an average particle diameter of the core particle is greater than or equal to about 2% and less than or equal to about 10%, an average particle diameter of the shell particle is greater than or equal to about 5 nanometers and less than or equal to about 30 nanometers, a ratio of the average particle diameter of the shell particle relative to the average particle diameter of the core particle is greater than or equal to about 0.016 and less than or equal to about 0.25, an average particle diameter of the complex particle is greater than or equal to about 90 nanometers and less than or equal to about 350 nanometers, a ratio of multipliers a volume resistance and a sheet resistance of the complex particle is greater than or equal to about 0.7 and less than or equal to about 1.4, wherein the ratio of multipliers is a ratio of $\beta_1/\beta_2$, wherein $\beta_1$ is an exponent in an expression of the volume resistance according to the formula $\rho_v=\alpha_1\cdot 10^{\beta 1}$ and wherein $\beta_2$ is an exponent in an expression of the sheet resistance according to the formula $\rho_s=\alpha_2\cdot 10^{\beta 2}$, and wherein a change of a number of shell particles present on the core particle before and after ultrasonic irradiation of a dispersion liquid of the complex particle including about 1 weight percent of the complex particle dispersed in water, using a power of about 110 Watts and a frequency of about 31 kiloHertz for about 30 minutes, is greater than or equal to about 0.5% and less than or equal to about 5%.

2. The complex particle of claim 1, wherein a relative permittivity of the complex particle is greater than or equal to about 2 and less than or equal to about 300.

3. The complex particle of claim 1, wherein a percentage of a surface of the core particle which is coated with the shell particle is greater than or equal to about 5% and less than about 68%, based on a total surface area of the core particle.

4. The complex particle of claim 1, wherein the core particle comprises an organic material and the shell particle comprises an inorganic material.

5. The complex particle of claim 4, wherein the shell particle further comprises an organic material.

6. The complex particle of claim 4, wherein the inorganic material comprises silica, titania, cerium oxide, strontium titanate, or a combination thereof.

7. The complex particle of claim 1, wherein the core particle comprises an inorganic material and the shell particle comprises an organic material.

8. The complex particle of claim 7, wherein the shell particle of the complex particle comprises an inorganic material.

9. The complex particle of claim 7, wherein the inorganic material comprises silica, titania, cerium oxide, strontium titanate, or combination thereof.

10. The complex particle of claim 7, further comprising an inorganic material layer coating on a surface of the core particle and on a surface of the shell particle.

11. An additive for a toner, the additive comprising the complex particle of claim 1.

12. A method of preparing a complex particle including a core particle and a shell particle, the method comprising:

providing a mixture comprising an organic particle and separately providing a mixture comprising an inorganic particle;

combining the mixture comprising the organic particle and the mixture comprising the inorganic particle to form a dispersion liquid;

adding an acid to the dispersion liquid until the dispersion liquid has an isoelectric point of an inorganic material of the inorganic core particle; and then heating the dispersion liquid to form a particle adhesion body comprising the inorganic particle on the organic particle; and adding a silane coupling agent to the heated dispersion liquid to prepare the complex particle.

* * * * *